US006390883B1

(12) United States Patent
Choi

(10) Patent No.: US 6,390,883 B1
(45) Date of Patent: May 21, 2002

(54) PROGRAMMABLE TOY WITH REMOTE CONTROL

(75) Inventor: Kei Fung Choi, Causeway Bay (HK)

(73) Assignee: Silverlit Toys Manufactory, Ltd, Causeway Bay (HK)

( * ) Notice: Subject to any disclaimer, the term of this patent is extended or adjusted under 35 U.S.C. 154(b) by 0 days.

(21) Appl. No.: 09/447,978

(22) Filed: Nov. 23, 1999

Related U.S. Application Data

(63) Continuation-in-part of application No. 09/288,951, filed on Apr. 9, 1999, now Pat. No. 6,250,987.

(51) Int. Cl.[7] ..... A63H 17/39; A63H 30/04

(52) U.S. Cl. ..... 446/436; 446/456; 446/462; 446/468

(58) Field of Search ..... 446/436, 437, 446/443, 456, 462, 465, 468

(56) References Cited

U.S. PATENT DOCUMENTS

| | | | | |
|---|---|---|---|---|
| 3,840,086 A | | 10/1974 | Burton | 180/204 |
| 4,198,620 A | | 4/1980 | Vogt et al. | 367/199 |
| 4,201,012 A | | 5/1980 | Marshall | 446/175 |
| 4,208,654 A | | 6/1980 | Vogt et al. | 341/20 |
| 4,390,877 A | | 6/1983 | Curran | 340/825.72 |
| 4,480,401 A | | 11/1984 | Matsushiro | 446/456 |
| 4,654,659 A | | 3/1987 | Kubo | 340/825.76 |
| 4,662,854 A | | 5/1987 | Fang | 446/175 |
| 4,702,718 A | * | 10/1987 | Yanase | |
| 4,712,184 A | | 12/1987 | Haugerud | 701/1 |
| 4,754,133 A | | 6/1988 | Bleich | 250/221 |
| 4,767,376 A | | 8/1988 | Hanzawa | 446/457 |
| 4,813,907 A | | 3/1989 | Rissman et al. | 446/175 |
| 4,907,804 A | * | 3/1990 | Arad et al. | |
| 5,100,153 A | | 3/1992 | Welte | 273/357 |
| 5,147,237 A | | 9/1992 | Kwan et al. | 446/297 |
| 5,216,337 A | * | 6/1993 | Orton et al. | 446/456 X |
| 5,334,075 A | | 8/1994 | Kakizaki et al. | 446/438 |
| 5,474,486 A | | 12/1995 | Chilton et al. | 446/456 |
| 5,481,257 A | | 1/1996 | Brubaker et al. | 340/825.69 |
| 5,697,829 A | * | 12/1997 | Chainani et al. | |
| 5,723,855 A | | 3/1998 | Oh et al. | 250/206.1 |

FOREIGN PATENT DOCUMENTS

DE 2259915 12/1972

OTHER PUBLICATIONS

Buddy–L "Ready Set Go" toy, SLM Inc., 1993.*
"OWI expands its line of do–it–yourself multi–market robots"; The Toy Book; Feb. 1991; p. 94.
"Heath's HERO–1 Robot"; BYTE Publications Inc.; Jan. 1983; pp 86–96.

* cited by examiner

*Primary Examiner*—John A. Ricci
(74) *Attorney, Agent, or Firm*—Oppenheimer, Wolff & Donnelly

(57) ABSTRACT

A programmable device such as a toy or novelty item has a keyboard which can be activated by a user to set up any one of multiple different motions of the toy. Sounds and lights can be activated to coordinate with the movement. The toy can be a car or other device capable of moving in the environment. The toy is also controllable by remote control through a receiver and transmitter system.

48 Claims, 25 Drawing Sheets

PROGRAMMABLE TOY WITH REMOTE CONTROL

RELATED APPLICATIONS

This application is a continuation-in-part of U.S. Ser. No. 09/288,951, filed Apr. 9, 1999 now U.S. Pat. No. 6,250,987. The contents of that application are incorporated herein by reference.

BACKGROUND OF THE INVENTION

This invention relates to a programmable system for enabling an object, preferably a toy or novelty item, to perform a series of actions chosen by a user.

Many toys or novelty items are available in the market which can perform different actions instructed by a player through the use of a remote control device. Typically the use of the remote control device results in a specific action of a toy object, for instance a vehicle. The remote control systems are either infrared, or radio controlled and can only be used to instruct the vehicle to perform individual or separate actions. These kind items are limited in the variability of their performance.

Having a variable programmable toy or novelty item would have distinct advantages and benefits in the consumer market.

The invention is directed to overcoming the limitations of existing toys and novelty items.

SUMMARY OF THE INVENTION

The invention provides for an interactive programming system for a toy or novelty item. A user, by pressing appropriate keypad buttons can program or instruct an object to perform a series of preset actions. These actions are preset in that different keys are programmed to operate or effect different actions on the toy or novelty item. This can preferably be accompanied by selected sound effects and light reactions.

According to the invention the programmable toy includes a body which has a motor for actuating a motion generator which can be in the form of wheels or other devices to cause the body to move through the surrounding environment. There is a keypad which operates a series of control switches for operation by the user of the toy. The switches are connected to a programmed or programmable microprocessor for translating the received signals from the switches into control signals for operating the motor. The motor can thereby be caused to activate the body in different selected directions according to the action of the motor on the motive generator.

In a preferred form of the invention there is a microprocessor which includes a memory function with which predetermined instructions for action and sound effects can be stored. The activities and objects to perform the action and sound effects are determined as selected by the user.

The programming system is driven by an integrated circuit chip which is responsive to the different keys.

The toy also includes a remote control facility whereby a transmitter and receiver system permits remote control of the toy.

The invention is further described with reference to the accompanying drawings.

DETAILED DESCRIPTION OF THE PREFERRED EMBODIMENT

Figure 1:
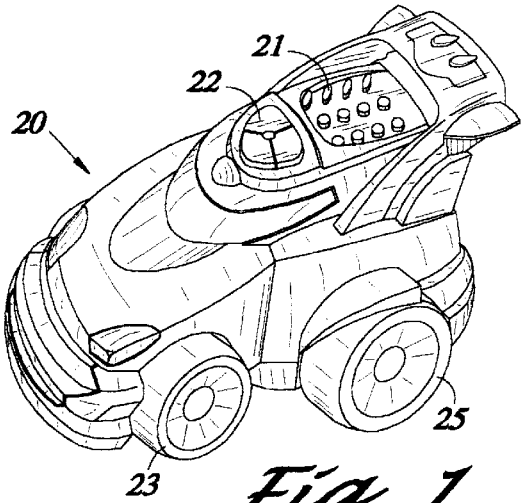
FIG. 1 is a perspective view showing a toy car in accordance with the invention.
Figure 2:
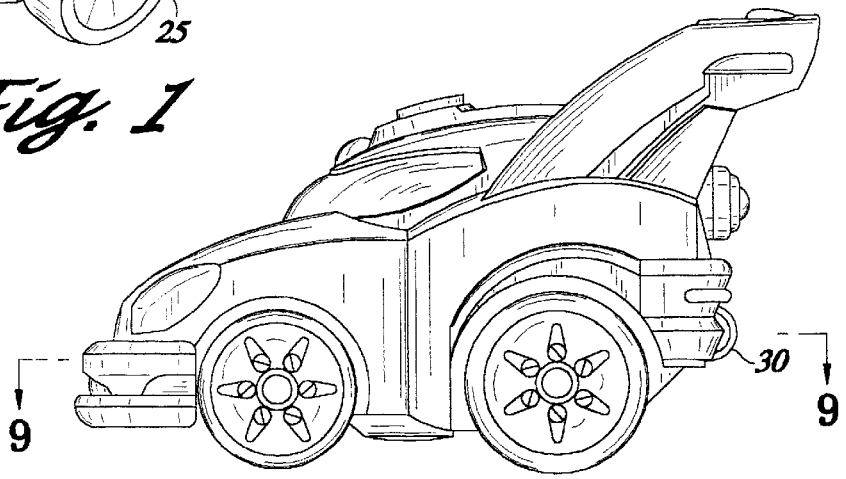
FIG. 2 is a side view of the car.

The invention is illustrated in relation to a car.

A vehicle 20 is shown with a keyboard 21 mounted on the top of the vehicle 20. There are twelve switches and there are also key switches 22 located in front of the keyboard 21. There are four spaced wheels, namely, front wheels 23 and 24 in the front of the vehicle 20 and rear wheels 25 and 26 in the rear of the vehicle 20. Wheels 25 and 26 are driven respectively by motors in a manner that will be described more fully below. The keyboard 21 includes three rows, each of four control switches. The row on the right side is generally indicated by numeral 27. Numeral 28 indicates the central row and numeral 29 is the row on the left side.

Figure 3:
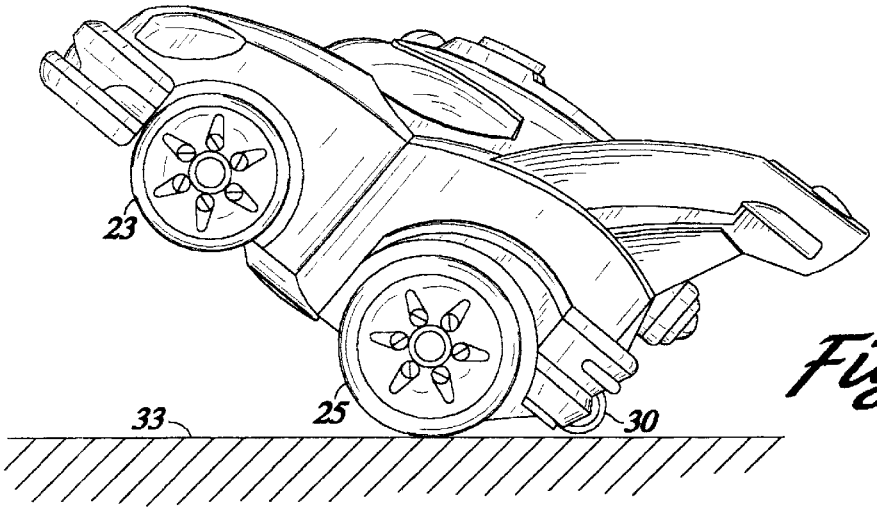
FIG. 3 is a side view showing the car on a surface in a pop wheel state.
Figure 4:
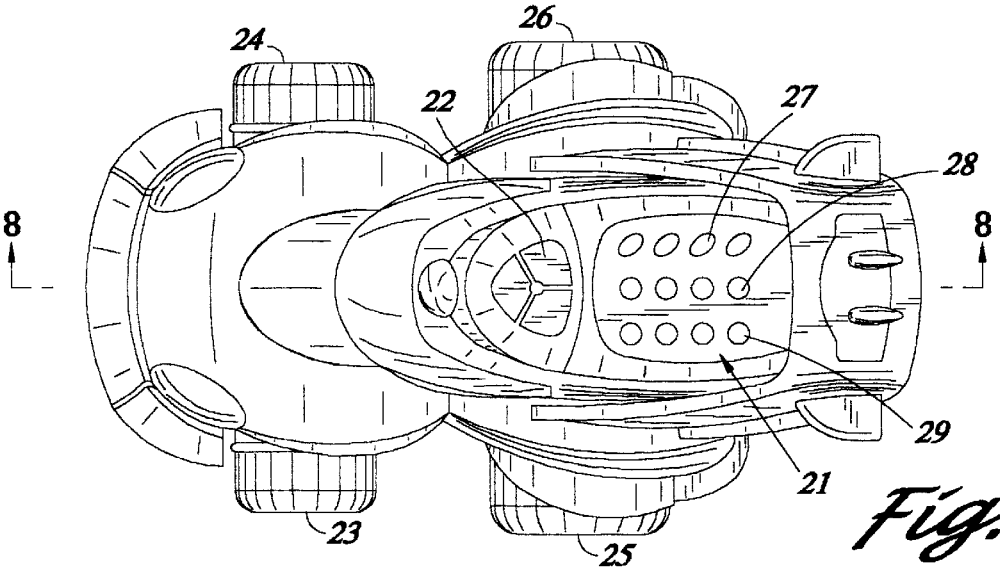
FIG. 4 is a top view of the car showing the keyboard with 12 keys and the three function switches.
Figure 5:
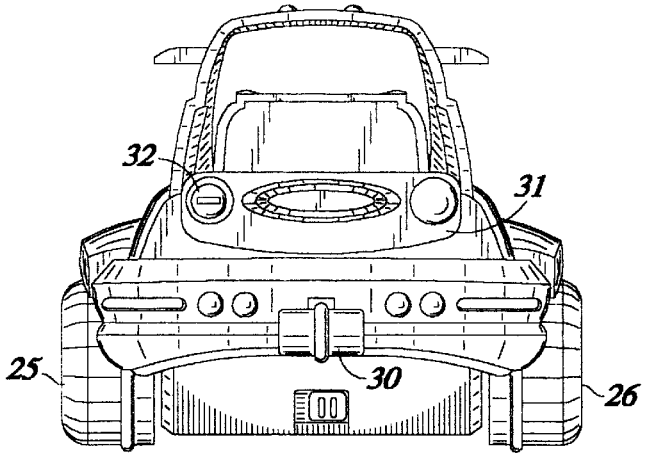
FIG. 5 is a rear view of the car.
Figure 6:
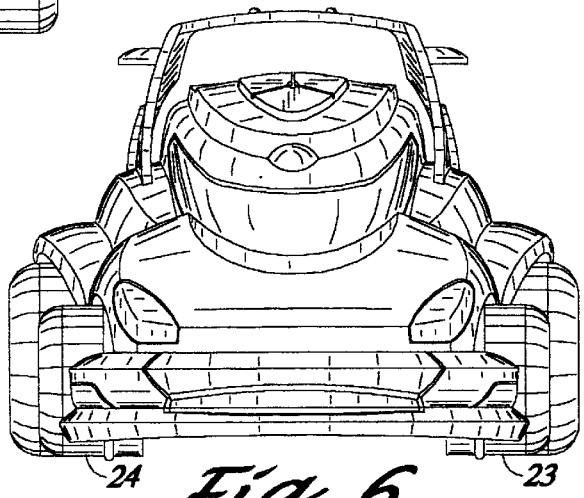
FIG. 6 is a front view of the car.
Figure 7:
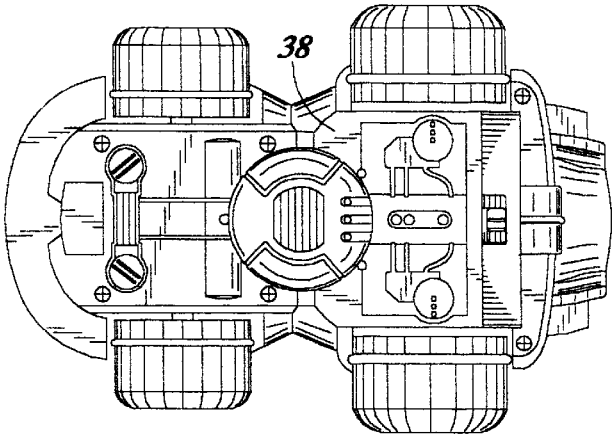
FIG. 7 is an underview of the car.

At the rear of the vehicle, there is a transversely located rotatable roller 30, which is operational when the vehicle 20 tips as illustrated in FIG. 3 into a pop wheel position. The center of gravity of the vehicle in this situation is established so that the rear wheel 25 and roller 30 can balance the vehicle in this position. The control system permits for the vehicle to tip when an appropriate signal is inserted into the keyboard 21.

The rear of the vehicle includes a battery compartment 31, which has a door, and into which several batteries can be located. The battery compartment 31 can be opened through a door switch or lock 32, which is appropriately turned to provide access or closure to the battery compartment 31.

When the vehicle tips, it balances on the surface 33 so that the wheel 25 and the roller 30 engage on that surface. The operation of the vehicle is such that it can move on the surface 33 in a forward, rearward, left turn, right turn, or side sinusoidal direction with smaller or larger curves as programmed into the vehicle 20.

The front wheels 23 and 24 are mounted on a suspension mechanism 34 with a suitable helical spring 35. The shell of the body is shown as numeral 36, and can be cast as plastic having an upper portion 37, which can be screw connected with a lower portion 38. Within the molded plastic components, there are support elements which can form the structure of the internal workings of the car. This includes a floor 39 for the battery compartment 31.

Figure 8:
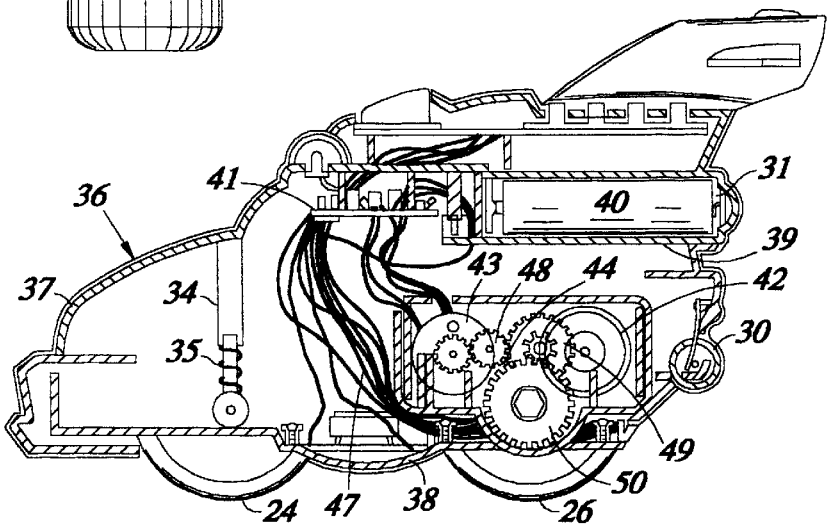
FIG. 8 is a sectional side view of the car showing the various mechanisms for driving the wheels and the electronic control system.
Figure 9:
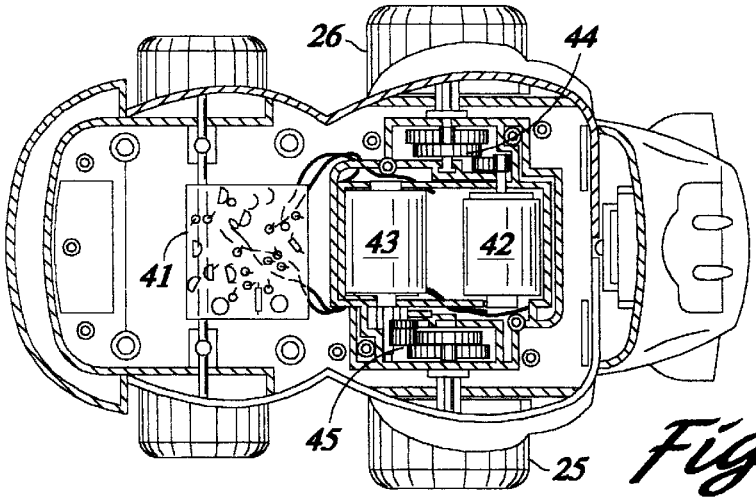
FIG. 9 is a sectional top view of the car showing the drive motors for driving the rear wheels of the vehicle.

At least one battery 40 is shown in the batter compartment 31 in FIG. 8. Mounted ahead of the battery compartment 31, there is a circuit board 41 which has in part the control circuit to drive two motors 42 and 43, respectively. Motor 42 is operational through a gear wheel mechanism 44 to operate the wheel 26, and motor 43 is operational through a gear wheel mechanism 45 to operate the wheel 25. Power from the control board 41 is directed through a series of conducting cables 47 to the motors, and in turn, the gear mechanisms. Gear mechanisms 44 include at least three interlocking gears 48, 49, and 50, which activate the wheel 26. A similar gear system 45 is applicable for wheel 25.

Figure 10:
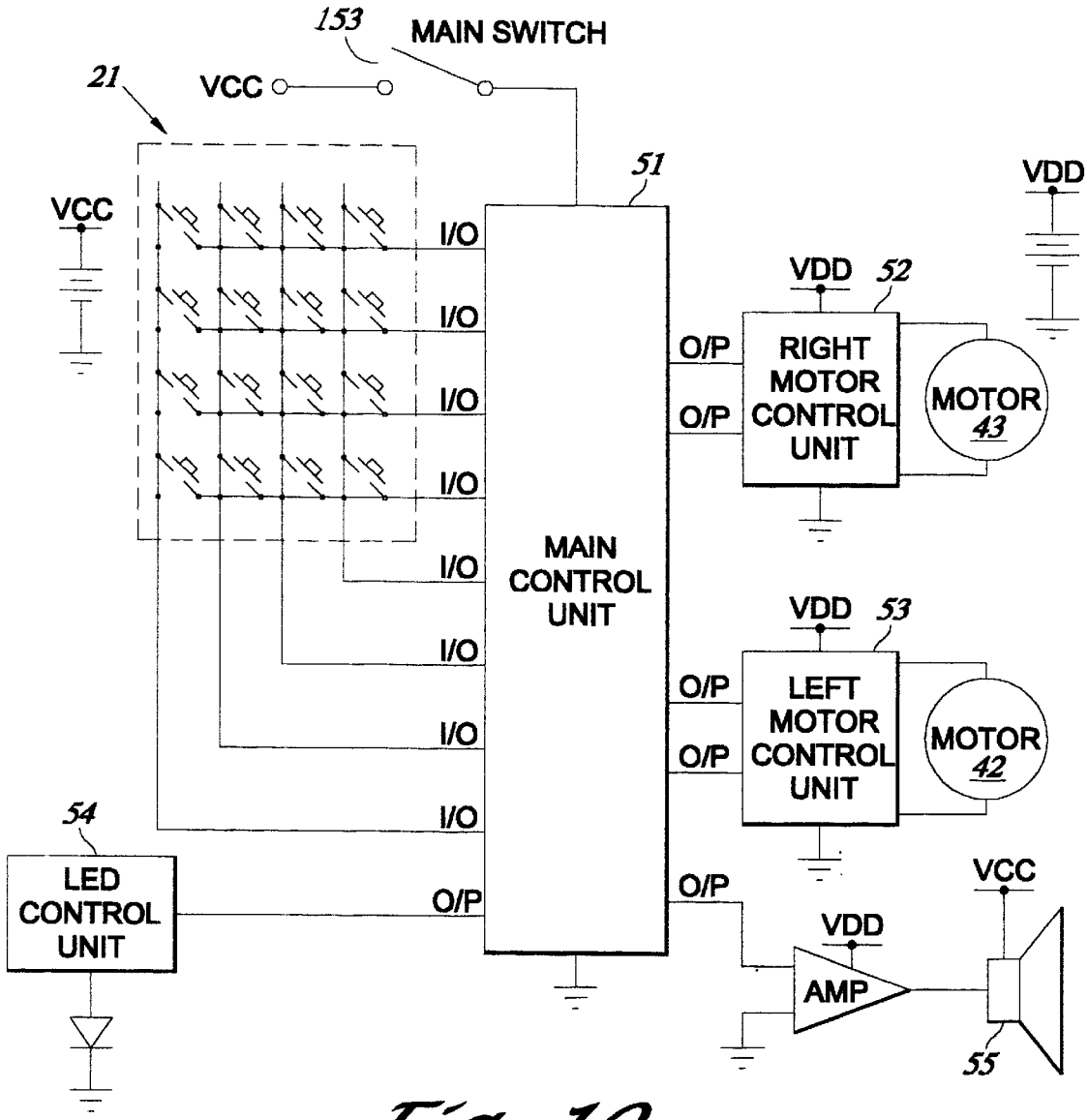
FIG. 10 is a block diagram illustrating the main components of the control units and the microprocessor.

In FIG. 10 there is shown a main control unit or microprocessor 51 connected with a right motor control unit 52 and a left motor control unit 53. The ON/OFF switch for the motor is represented in FIG. 10 by numeral 153, and the keyboard 21 is also shown with the multiple keyboard switches connected to the microprocessor main control unit 51. The keyboard switches are press button elements which close circuits as indicated in the keyboard configuration 21 as shown. The microprocessor also controls a light source LED control unit 54, which is operational under given programmed conditions of the processor 51. There is also a speaker 55 which is operational under the control of microprocessor 51.

Figure 11:
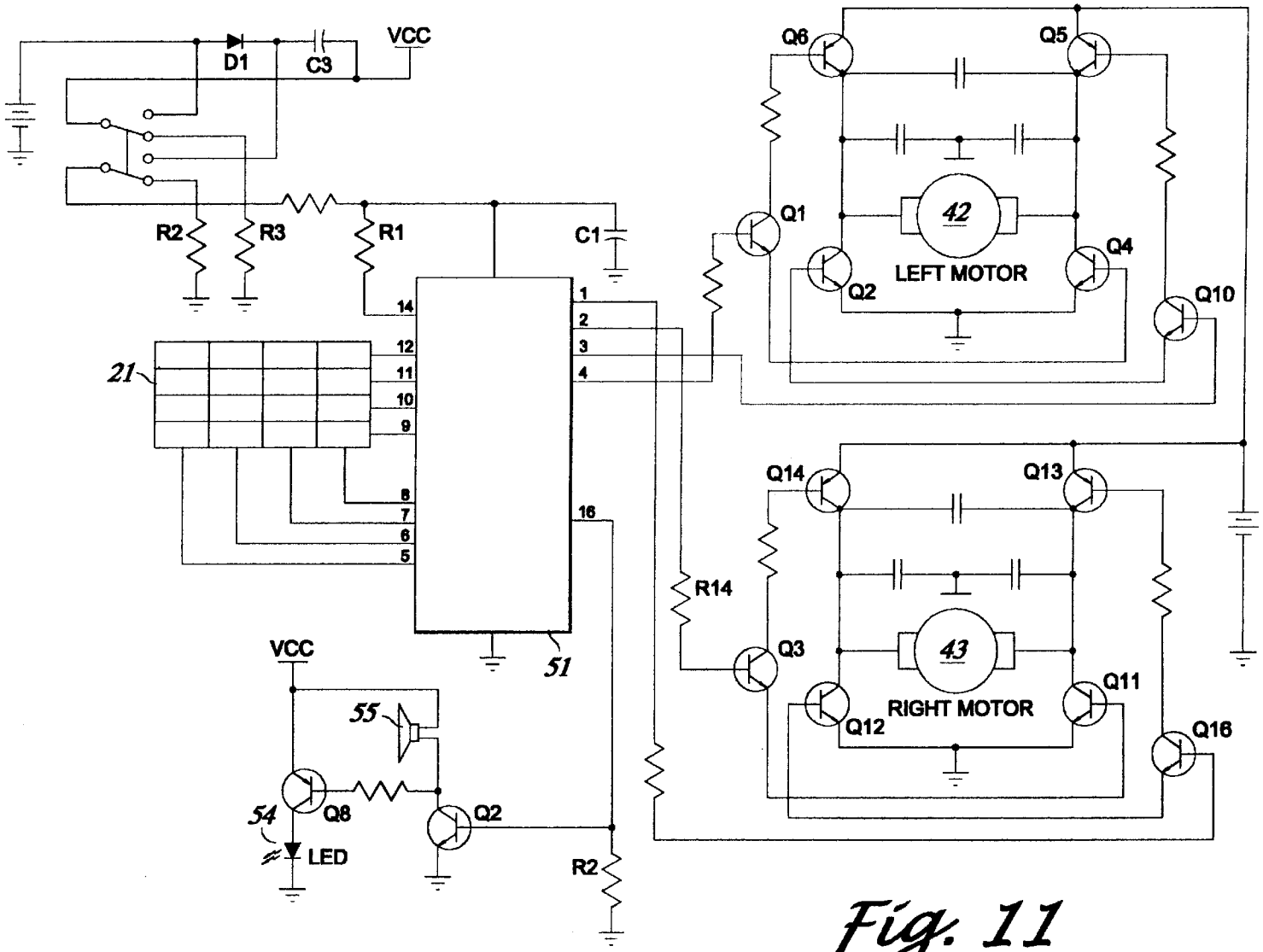
FIG. 11 is a more detailed view of the control circuits and the microprocessor.

The control circuit and microprocessor are described in further detail with reference to FIG. 11.

The control circuit drives the two motors 42 and 43 and a speaker circuit 55 and LED circuit 54. Transistor pairs are used for driver circuits. The microprocessor 51 has five outputs, labeled 1, 2, 3, 4, and 16. The inputs come from lines 5–12. When lines 5–12 present proper configurations given in the table, outputs 1–4 and 16 are driven by the microprocessor 51.

When output 1 goes high, the base of transistor Q16 receives the proper voltage to turn Q16 on, which allows current to flow through the collector and emitter of Q16. This, in turn, raises the voltages at the bases of Q13 and Q12 to turn Q12 and Q13 on, and since Q13 is connected to power, this passes current through right motor 43 in a first direction.

When output 2 goes high, the base of transistor Q3 receives the proper voltage to turn Q3 on, which allows current to flow through the collector and emitter of Q3. This, in turn, raises the voltages at the bases of Q11 and Q14 to turn Q11 and Q14 on, and since Q14 is connected to power, this passes current through right motor 43 in a second direction.

When output 3 goes high, the base of transistor Q10 receives the proper voltage to turn Q10 on, which allows current to flow through the collector and emitter of Q10. This, in turn, raises the voltages at the bases of Q5 and Q7 to turn Q5 and Q7 on, and since Q5 is connected to power, this passes current through left motor 42 in a first direction.

When output 4 goes high, the base of transistor Q1 receives the proper voltage to turn Q1 on, which allows current to flow through the collector and emitter of Q1. This, in turn, raises the voltages at the bases of Q4 and Q6 to turn Q4 and Q6 on, and since Q6 is connected to power, this passes current through left motor 42 in a second direction.

When output 16 goes high, the base of transistor Q2 receives the proper voltage to turn Q2 on, which allows current to flow through the collector and emitter of Q2. Since the collector of Q2 is connected to one of the speaker leads, and the other speaker lead is connected to power, this drives the speaker 55. Further, the collector of Q2 is connected to the base of Q8, and when Q2 is on, Q8 is on. When Q8 is on, current flows through the LED 54, causing it to emit light.

Example Toy and Operational Characteristics

An exemplary toy automobile with the programmable features has the following characteristics: an infinite amount of programming possibilities, about $128^{16}$; programmability; 8 action keys; 4 distance or timer keys; and 3 function keys. The function keys are designated as Go; Demo; and Shift keys.

Sound Effects can include screeching, honking, speeding, acceleration, engine noise and other verbal sounds. These sounds can be related to the action of the car.

Programmable Car

The dual motor programmable car is preset with 3 demo functions, there are also 8 action keys, 4 timer keys and shift keys for programming which store up 32 controlling features and 16 interactive process memory positions. The programmable car reproduces sound effects in following the movements. There is an LED light which acts and reacts and matches the action of the car.

When the ON/OFF is turned to be in the "ON" position, the car honks twice telling the user that it is ready. The demo button or program button is then used. Pressing the Demo Key 8 once, twice or three times activates 3 different demonstration operations of the automobile.

The different levels of programming are the following.

Beginning Programming

Press one Action Key and one Timer Key. Press "GO". Repeat the above basic function and add a second Action Key and a second Timer Key, before pressing "GO". The car holds up to sixteen different actions & timers on each run.

Intermediate Programming

Adding the Shift Key (before the Action Key or the Timer Key) to the basic programming alters the original actions. Press the Shift Key and one Action Key at the same time. Then press a Timer key. Press "GO". This program alters the action making it different than the basic program. Press one Action Key. Then press the Shift Key and one Timer Key at the same time. Press "GO". This program alters the timing making it different than the basic program.

Advanced Programming

Adding the Shift Key (before the Action Key and the Timer Key) to the basic programming alters the original actions. Press the Shift Key and one Action Key at the same time. Then press the Shift Key and one Timer Key at the same time. Press "GO". This program alters the action and timing making it different to the basic and intermediate program.

To interrupt the program while the car is in action, press the "GO" Key and the car stops. To repeat the last programmed action, press the "GO" Key and the car repeats the last programming. Should the user input the wrong program and want to start over, press the Shift Key down for 3 seconds. The car beeps telling the user that the memory has been erased. There is an automatic shut off after 30 minutes if the car is left in the "ON" position. Within these 30 minutes, a reminding horn sounds every five minutes inviting new play and programming.

If desired, function cards can be provided for multiple combination of keys.

The keys assignment are as follows:

Key Description

These are the keys located on the keyboard 21.

Key 1 (Action Key: 4 different modules)

- Forward: Key 1+Timer Key (Time base 2.0 sec.)
- Forward: Key 1+Shift (Timer) Key (Time base 0.5 sec.)
- Turbo Forward: Shift (Key 1)+Timer Key (Time base 2.0 sec.)
- Pause: Shift (Key 1)+Shift (Timer) Key (Time base 0.5 sec.)

Key 2 (Action Key: 4 different modules)

- Backward: Key 2+Timer Key (Time base 2.0 sec.)
- Backward: Key 2+Shift (Timer) Key (Time base 0.5 sec.)
- Turbo Backward: Shift (Key 2)+Timer Key (Time base 2.0 sec.)
- Vibration: Shift (Key 2)+Shift (Timer) Key (Time base 0.5 sec.)

Key 3 (Action Key: 4 different modules)

- Turn Left Forward: Key 3+Timer Key (Time base 2.0 sec.)
- Turn Left Forward: Key 3+Shift (Timer)
- Irregular Polygon I: Shift (Key 3)+Timer Key
- Rotate—Anti-clockwise: Shift (Key 3)+Shift (Timer) Key Key 4 (Action Key: 4 different modules)

- Turn Left Backward: Key 4+Timer Key (Time base 2.0 sec.)
- Turn Left Backward: Key 4+Shift (Timer) Key (Time base 0.5 sec.)
- Transverse Line (Left): Shift (Key 4)+Timer Key
- Shaking 3 times: Shift (Key 4)+Shift (Timer) Key Key 5 (Action Key: 4 different modules)

- Sine-Curve (Small): Key 5+Timer Key
- Sine-Curve (Big): Key 5+Shift (Timer) Key
- Circle I: Shift (Key 5)+Timer Key
- Circle II: Shift (Key 5)+Shift (Timer) Key Key 6 (Action Key: 4 different modules)

- Pop Wheelies: Key 5+Timer Key
- Pop Wheelies & Down: Key 6+Shift (Timer) Key
- Makes '8' small turns: Shift (Key 6)+Timer Key
- Makes '8' bigger turns: Shift (Key 6)+Shift (Timer) Key Key 7 (Action Key: 4 different modules)

- Turn Right Forward: Key 7+Timer Key (Time base 2.0 sec.)
- Turn Right Forward: Key 7+Shift (Timer) Key (Time base 0.5 sec.)
- Irregular Polygon II: Shift (Key 7)+Timer Key
- Rotate—Clockwise: Shift (Key 7)+Shift (Timer) Key Key 8 (Action Key: 4 different modules)

- Turn Right Backward: Key 8+Timer Key (Time base 2.0 sec.)
- Turn Right Backward: Key 8+Shift (Timer) Key (Time base 0.5 sec.)
- Transverse Line (Right): Shift (Key 8)+Timer Key
- Pop Wheelies & Shaking 3 times: Shift (Key 8)+Shift (Timer) Key Key 9 (Timer Key)

- Time base×1

Key 10 (Timer Key)

- Time base×2

Key 11 (Timer Key)

- Time base×3

Key 12 (Timer Key)

- Time base×4

The keys 22 are the following:

Shift Key (Shifts the different modules of Key 1 to Key 12)

- The Shift key is simultaneously active with any one of the other keys.
- Press and hold the Shift key for 3.0 seconds erases the input program.

Demo Key (Select 3 different pre-set program)

- Press button once (Simple program function)
- Press button twice within 2.5 seconds (Complex program function)
- Press button three times within 2.5 seconds (Complicated program function)

Go Key (Start a program)

- Press 'Go' key once after a program is completed to start the program
  - Press 'Go' key to stop the action when the car is moving LED Indicator This is located in the car 20 and is synchronized with sound which is a speaker in the car 20.

Loudspeaker

- Sound signal is preset and relates with functions
- Voice signal is preset and relates to the 'Go' key Motor Control

- Drives the two DC motor forward or backward
- Controls the speed of motor by the output current
- Protects the circuit due to the back current Operation Description When the power is on, and the battery is charged, the system goes to a stand-by stage, and a sound signal is made, such a honking :'Beep . . . Beep . . . Beep". In the normal stand-by stage, the car performs a sound signal every 5 minutes (maximum 5 times) if no command is input or when the program has been completed. Programming is effected by a keying in procedure. The Action+Timer is one action process. There is a step by step keying in process, with a maximum of 16 interactive processes.

Example sequences of nine different keying sequences are now described. Whatever command keys are pressed, there is no right or wrong keying, and the car functions according to the last right keyed-in procedure. GP1, GP2, GP3 [Action Key and Time Key] represent right keying actions. Xa [Action Key Only] represents a wrong key only. Xt [Time Key Only] represents a wrong keying. Action 1, Action 2 represents programmed sequential movements, respectively.

1) GP1+GP2+GP3+Go. The car functions and goes through process of "GP1" +"GP2" +"GP3".
2) Xt+Go. The car functions but only goes through a process which has been set beforehand.
3) Xa+Go. The car is not activated.
4) GP1+GP2+GP3+Preset Action 1+Go. The car functions and goes through process of "GP1" +"GP2" +"GP3". "Go" key should be pressed within two seconds after the "preset action" key is pressed. Otherwise, the car performs the function in Preset Action 1.
5) GP1+GP2+GP3+Preset Action 1. The car functions and goes through the process of "Preset Action 1".
6) GP1+Xa+GP2+Xa+Go. The car functions and goes through the processes of "GP1" +"GP2".
7) Action1+Time1+Time2+Action2+Time1+Time2+Go. The car functions and goes through processes of "Action1+Time2" and then "Action2+"Time2".
8) Go+Preset Action. The car functions but goes through the process of Preset Action. No program already existed.
9) Preset Action+Go. The car stops. "Go" key should be pressed within two seconds after the "preset action" key is pressed. Otherwise, the car performs the function in Preset Action 1.

At any time during the car's movements based on correctly keyed-in procedures, the car stops canceling all programmed actions should the "Go" key be pressed.

Many other forms of the invention exist each differing from others in matters of detail only.

Figure 12A:
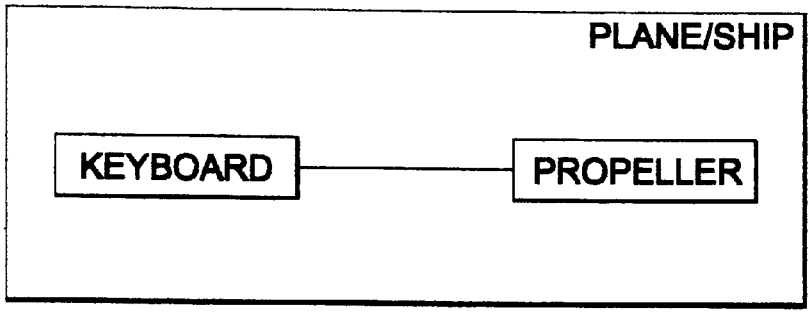
FIG. 12*a* is a representative view of a plane or ship having a keyboard and propeller.
Figure 12B:
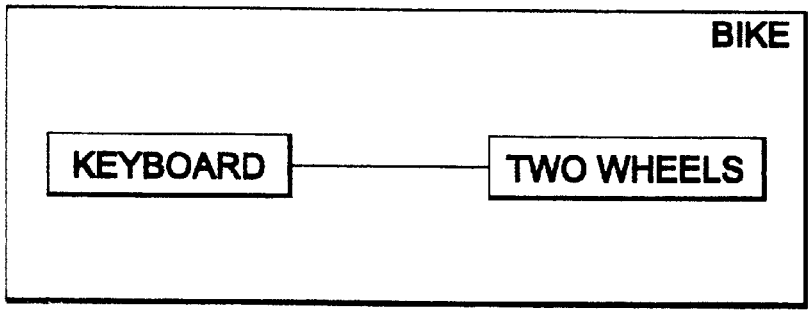
FIG. 12*b* is a representative view of a bike having a keyboard and two wheels.

Although the invention has been described with reference to a four-wheeled automobile vehicle it is clear that the invention also has application to other devices such as different toys or novelty items. The kind of toys could be a ship, plane, different kind of automobile such as a three-wheeler, or a motor bike, for instance as shown in FIG. 12B. The surrounding environment would be appropriately a surface, or could be the water in the case of a ship, or air in the case of a plane. In the case of a ship, boat, or plane, the motive generator can be a propeller or screw device. This is illustrated in FIG. 12A.

Figure 12C:
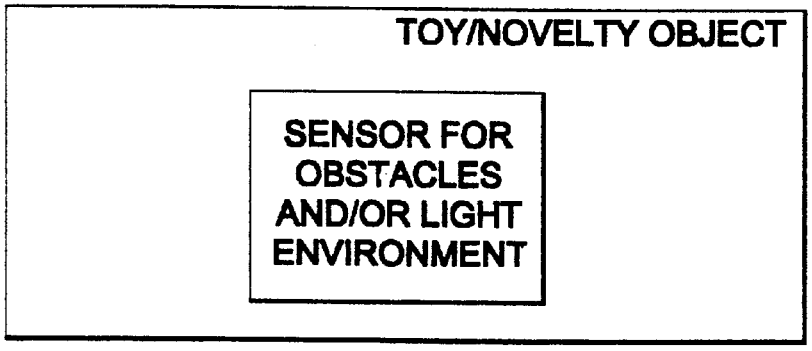
FIG. 12*c* is a representative view of a toy or novelty object where there is a sensor for obstacles and/or light environment.
Figure 13:
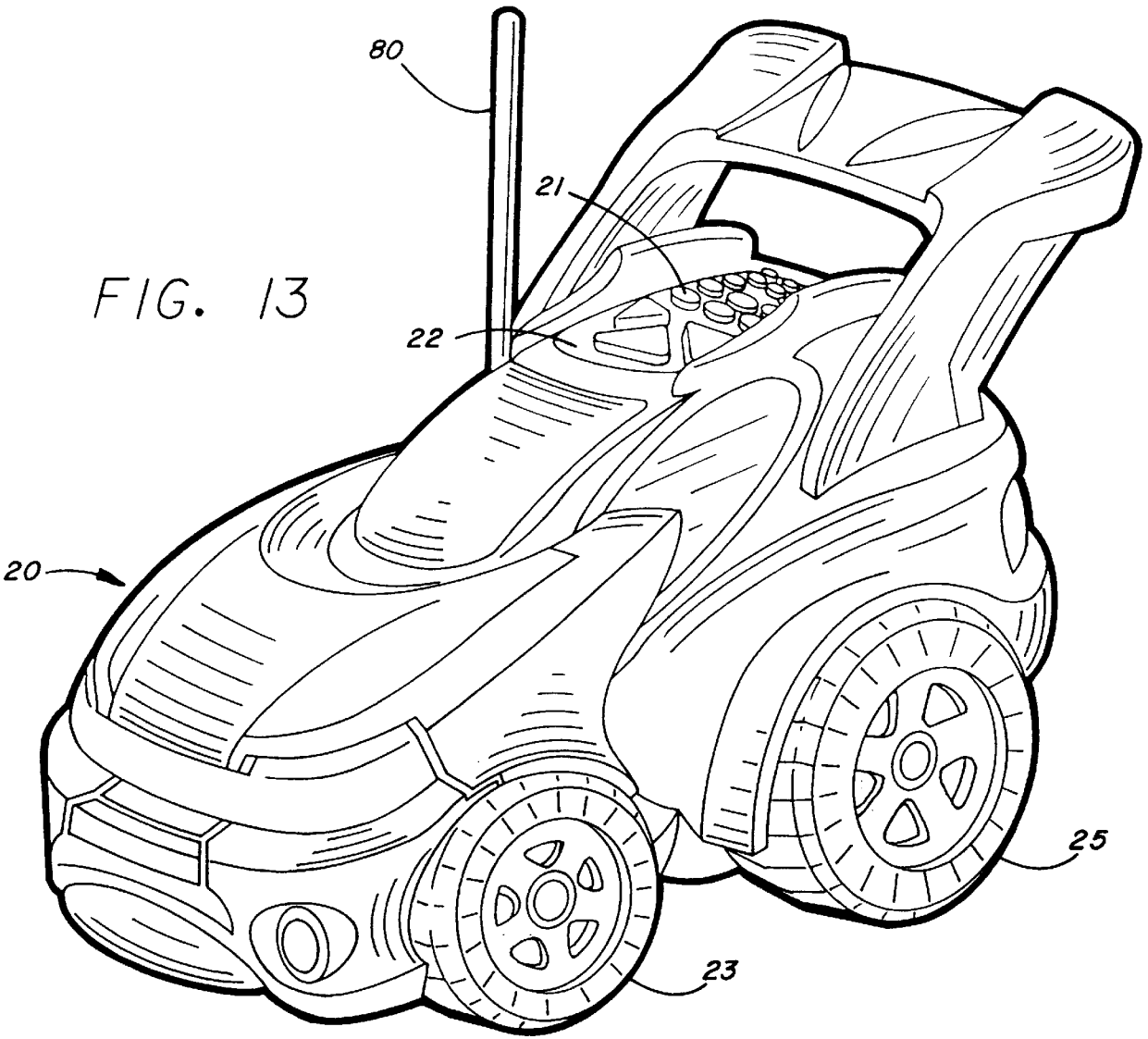
FIG. 13 is a perspective view showing a toy car in accordance with the invention.
Figure 14:
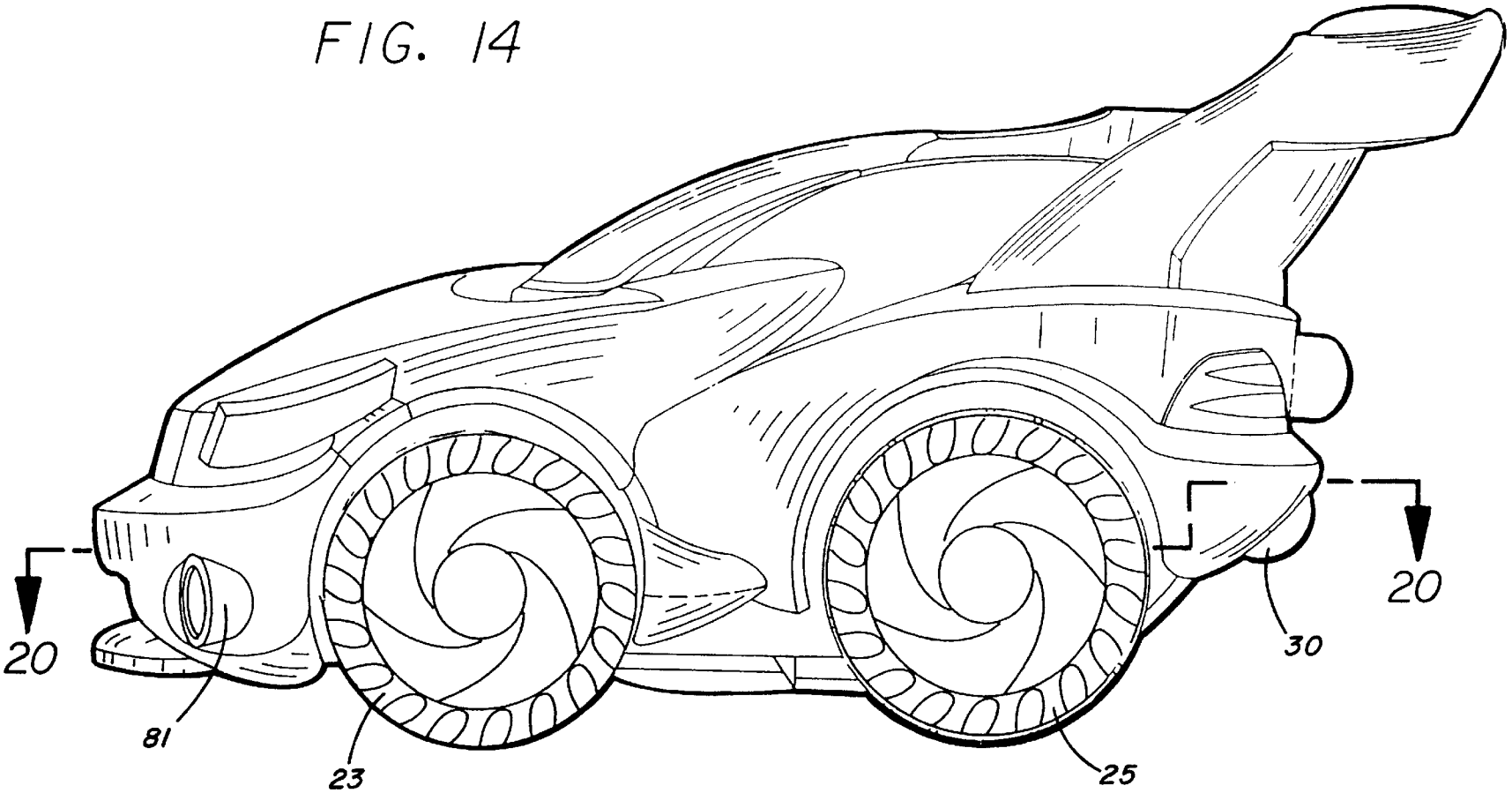
FIG. 14 is a side view of the car.
Figure 15:
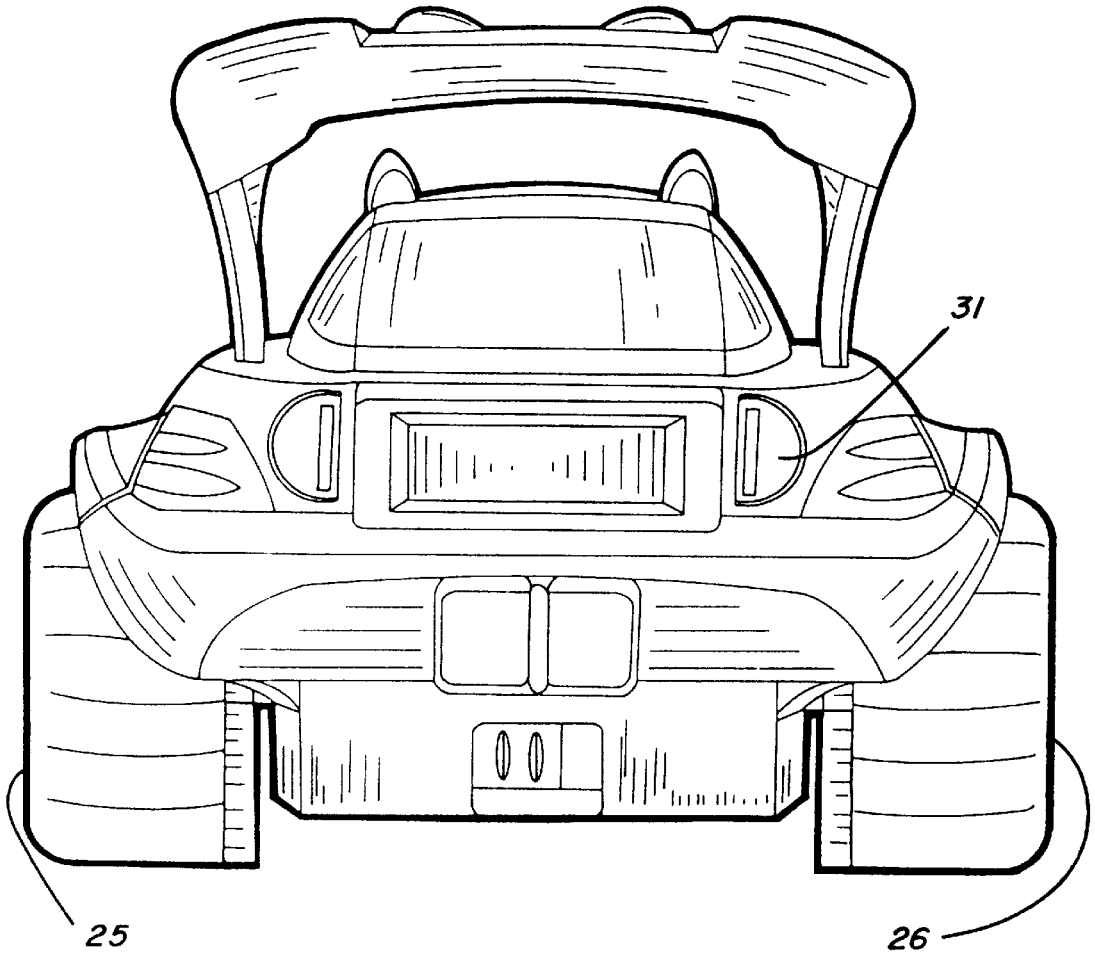
FIG. 15 is a rear view of the car.
Figure 16:
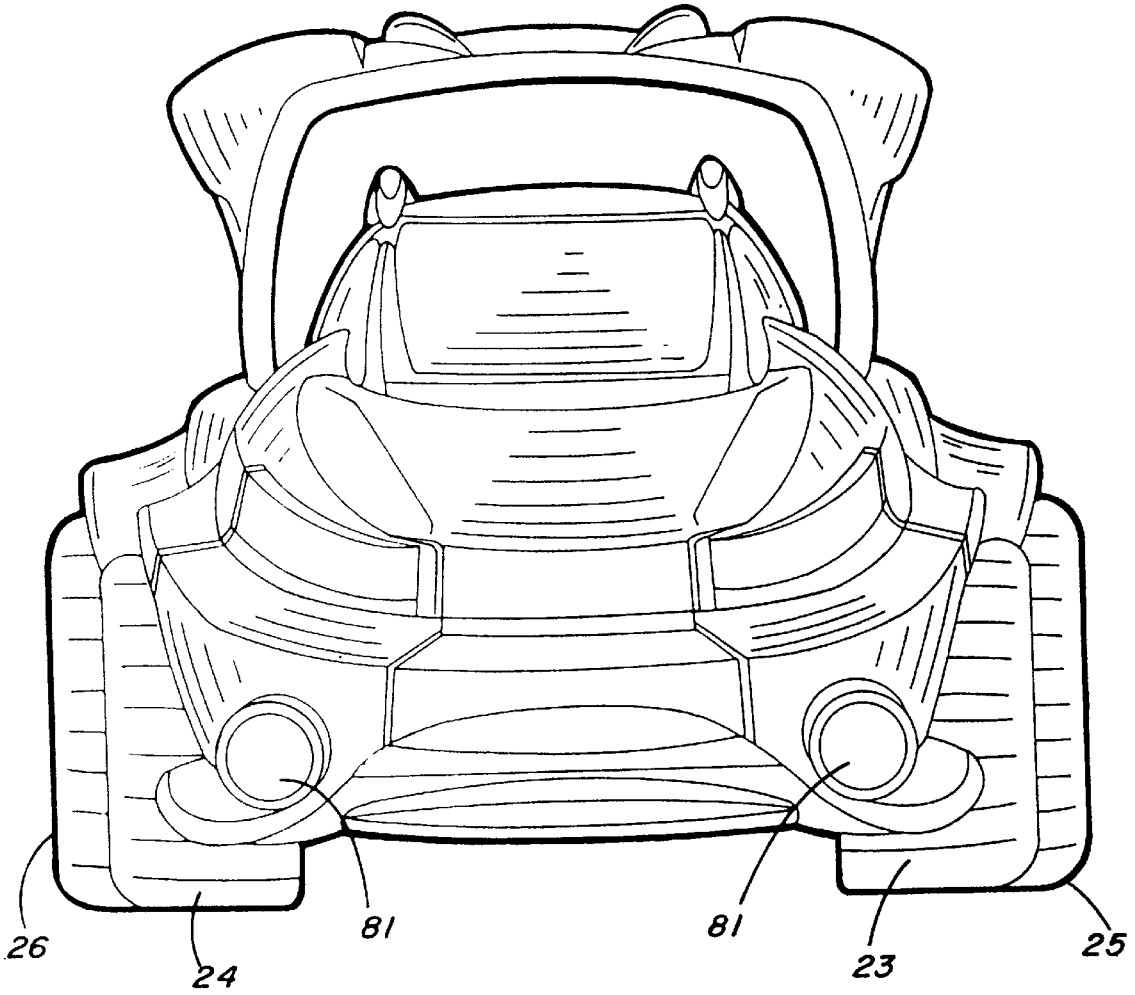
FIG. 16 is a front view of the car.
Figure 17:
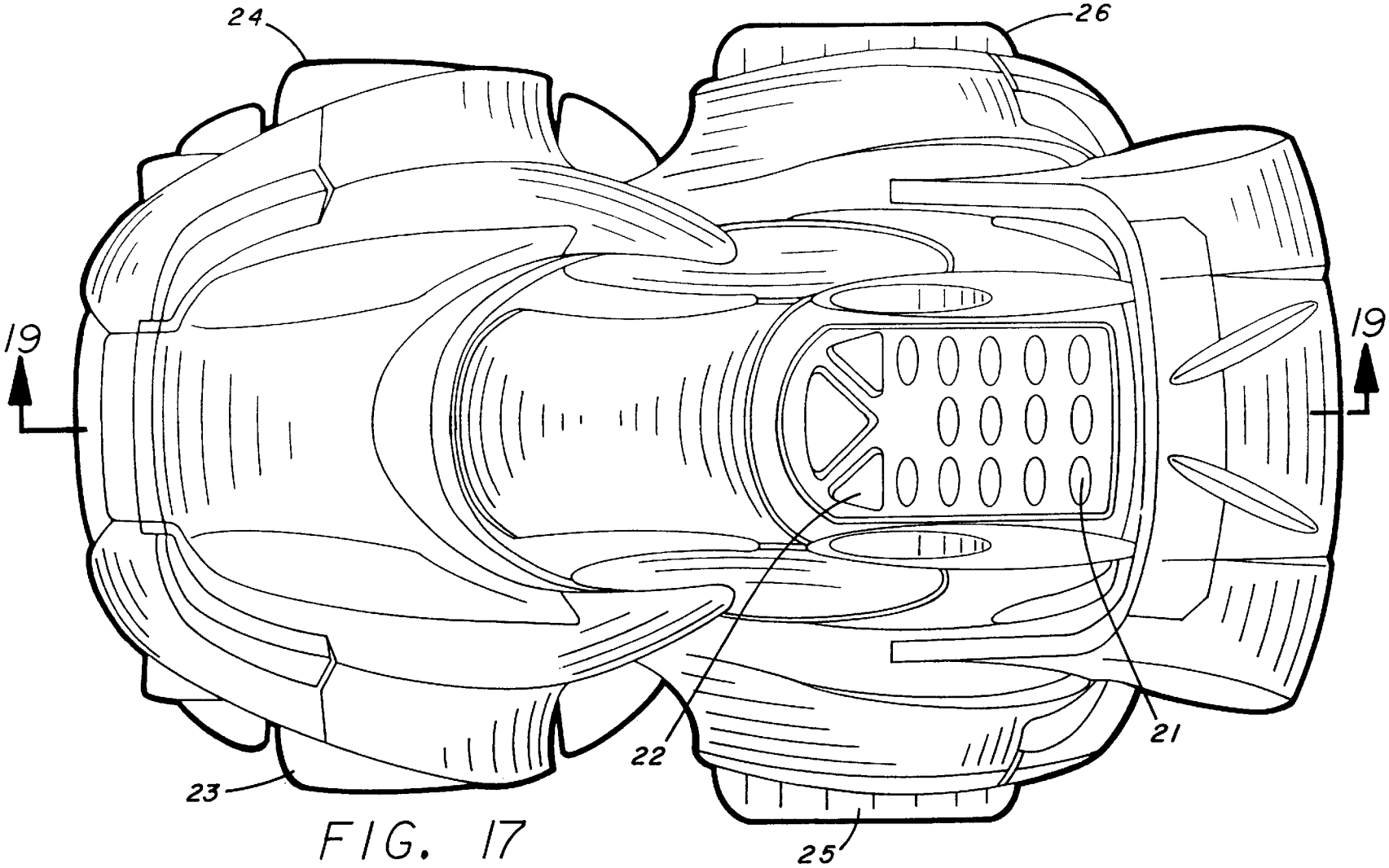
FIG. 17 is a top view of the car showing the keyboard with 12 keys and the three function switches.
Figure 18:
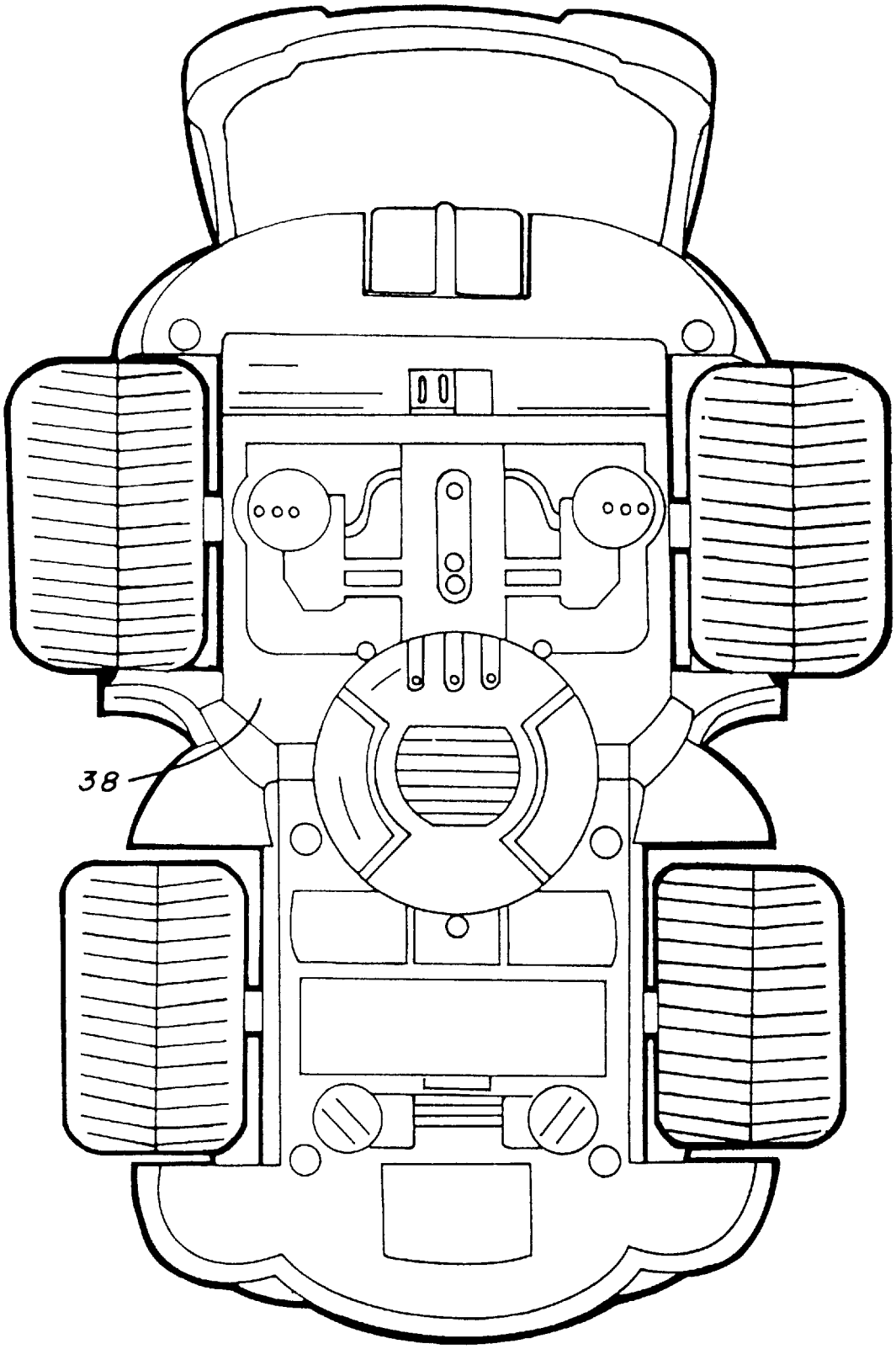
FIG. 18 is an underview of the car.
Figure 19:
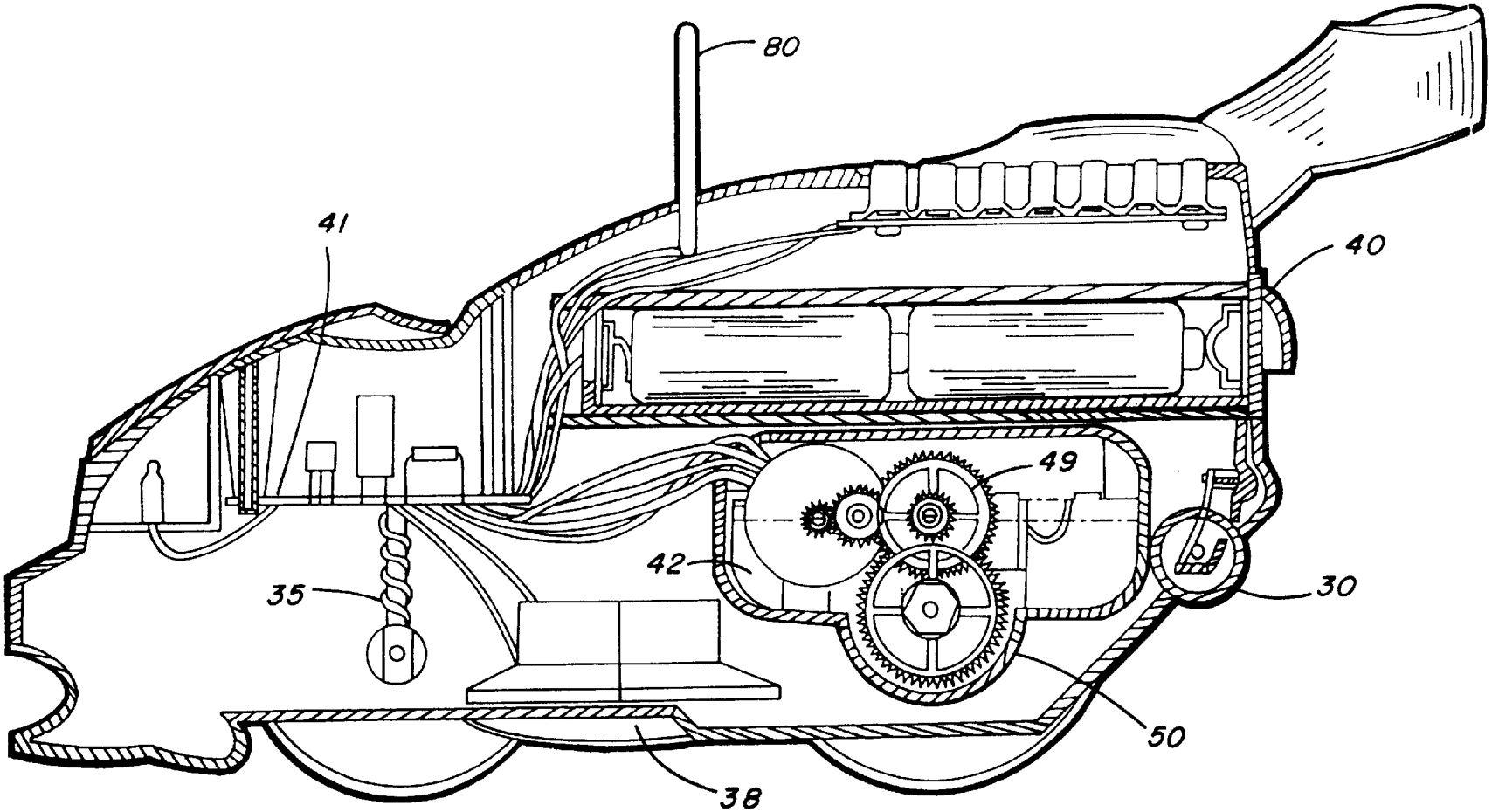
FIG. 19 is a sectional side view of the car showing the various mechanisms for driving the wheels and the electronic control system.
Figure 20:
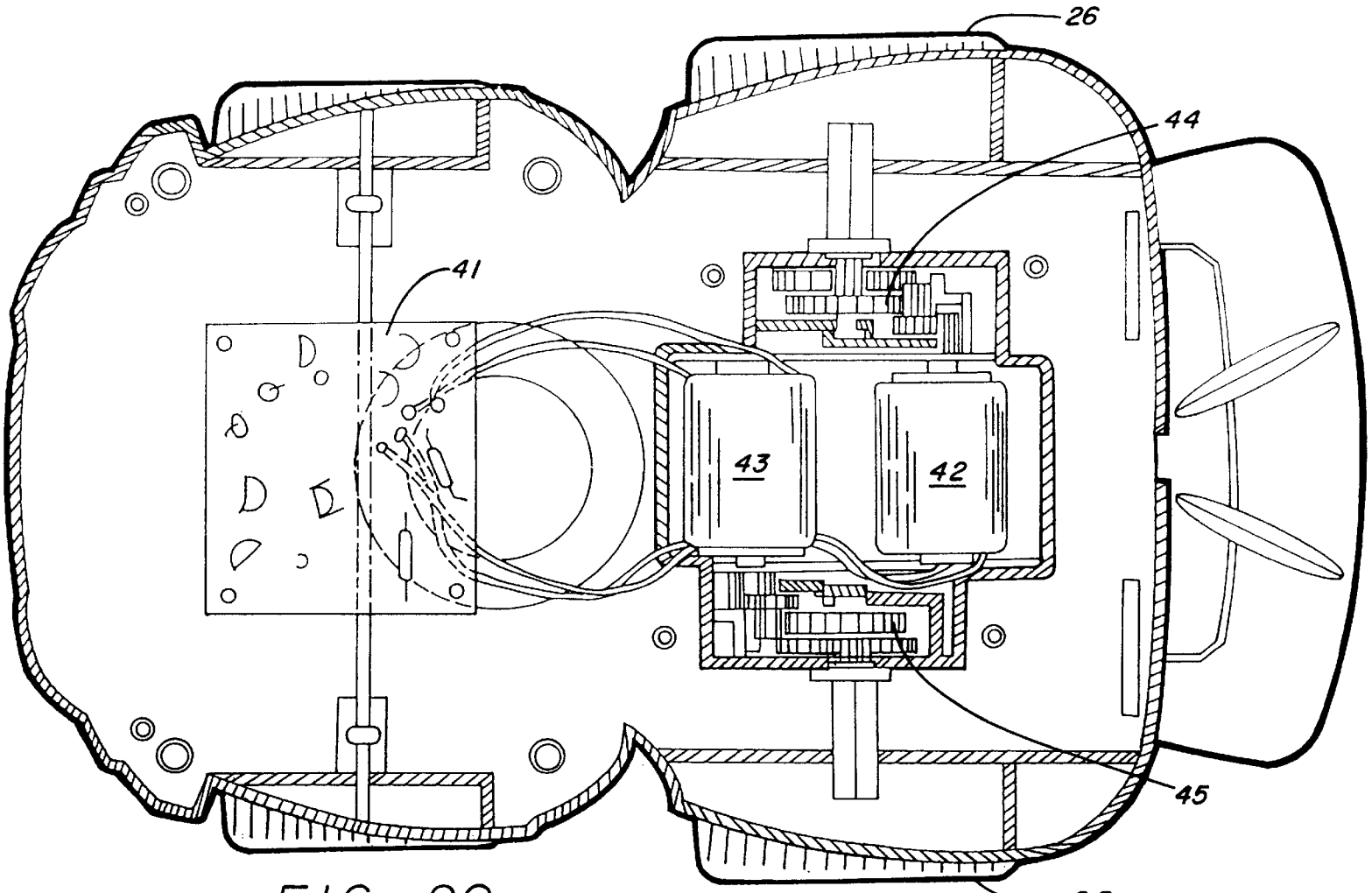
FIG. 20 is a sectional top view of the car showing the drive motors for driving the rear wheels of the vehicle.
Figure 21:
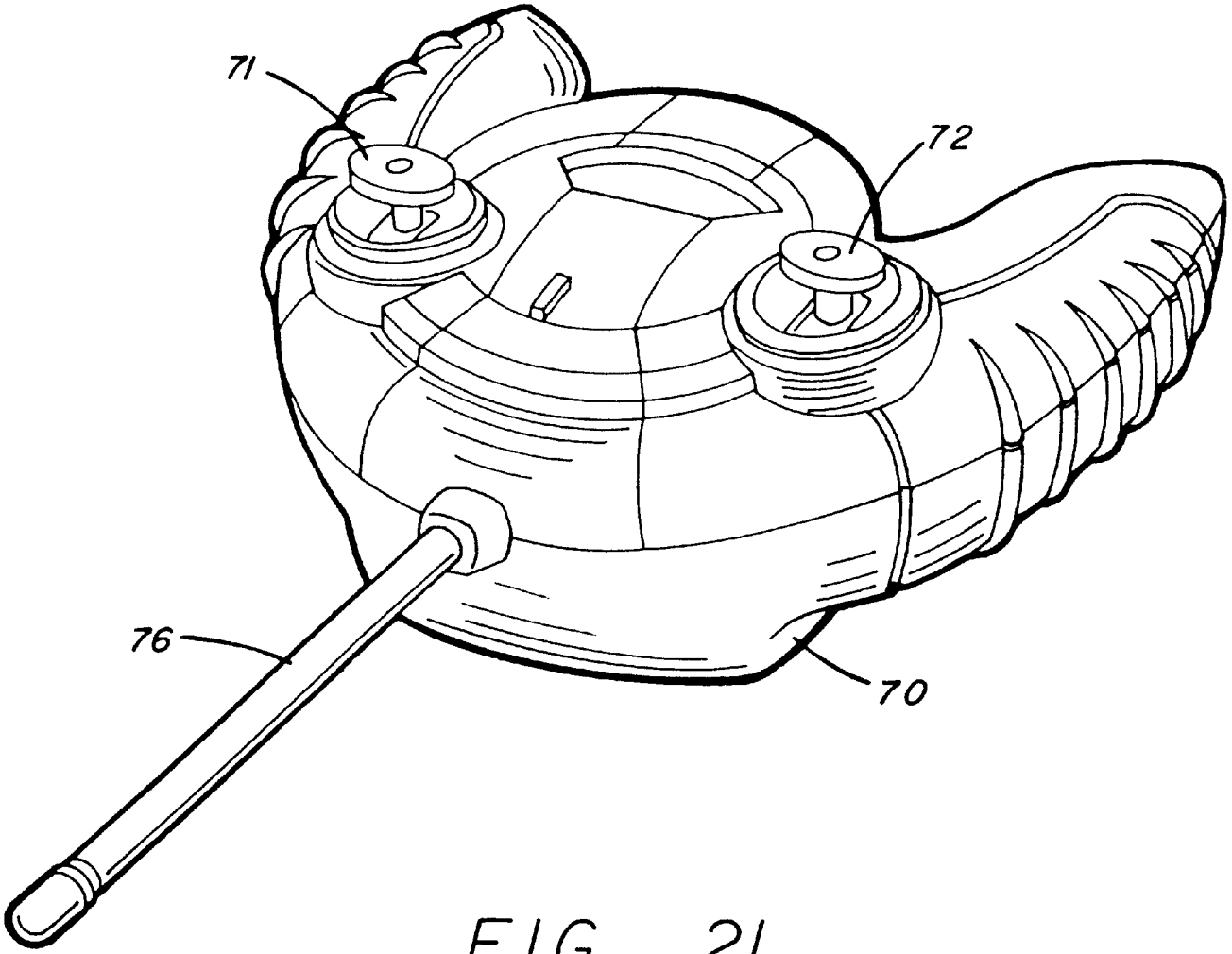
FIG. 21 is a perspective view of a handheld remote control unit.
Figure 22:
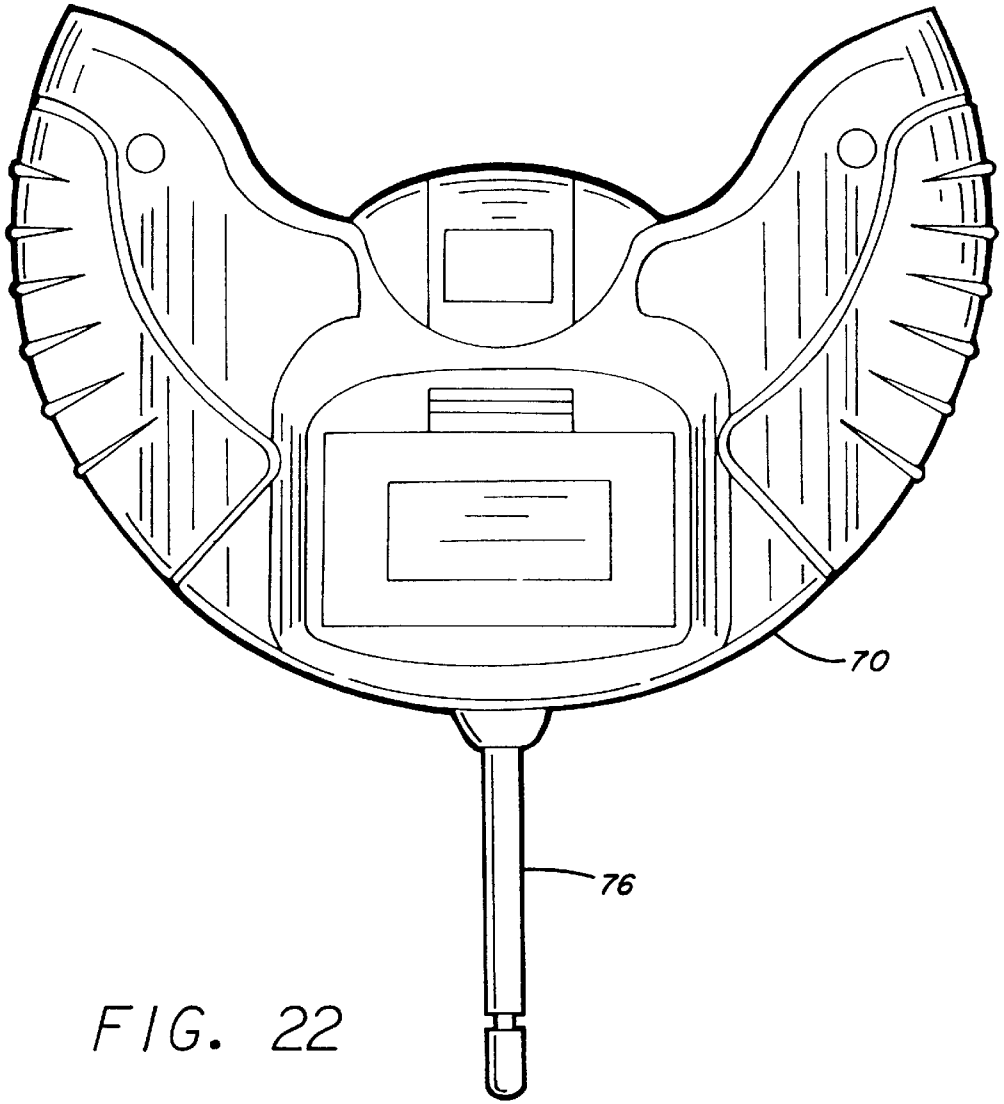
FIG. 22 is an underview of a handheld remote control unit.
Figure 23:
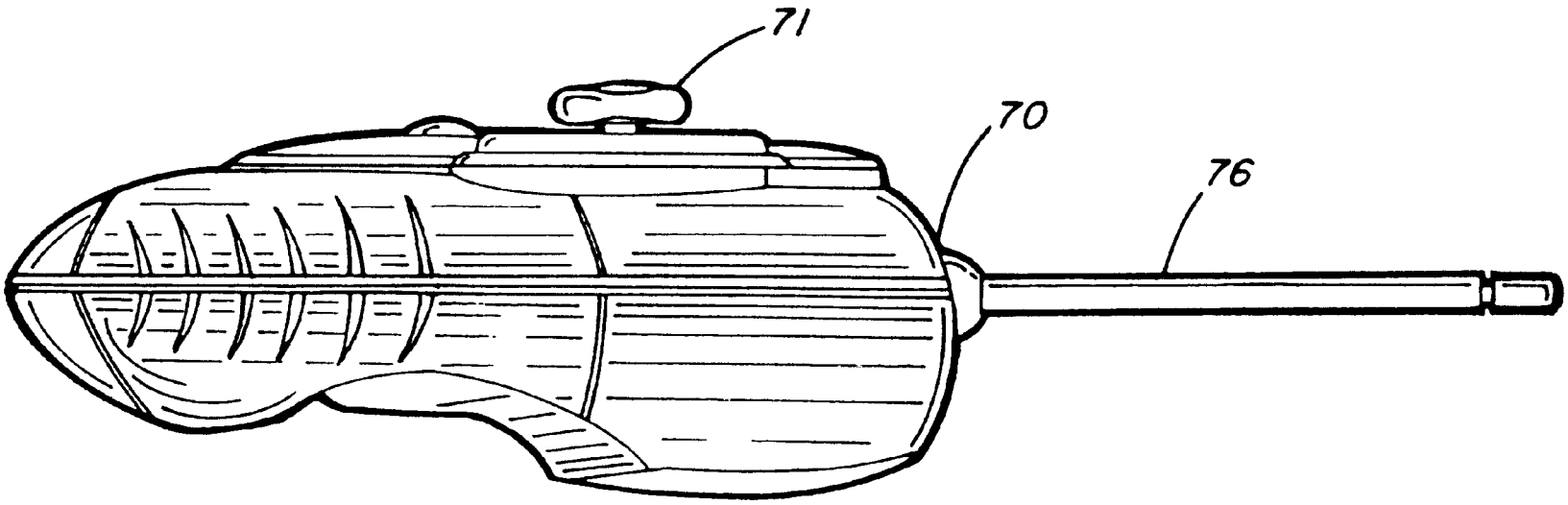
FIG. 23 is a side view of a handheld remote control unit.
Figure 24:
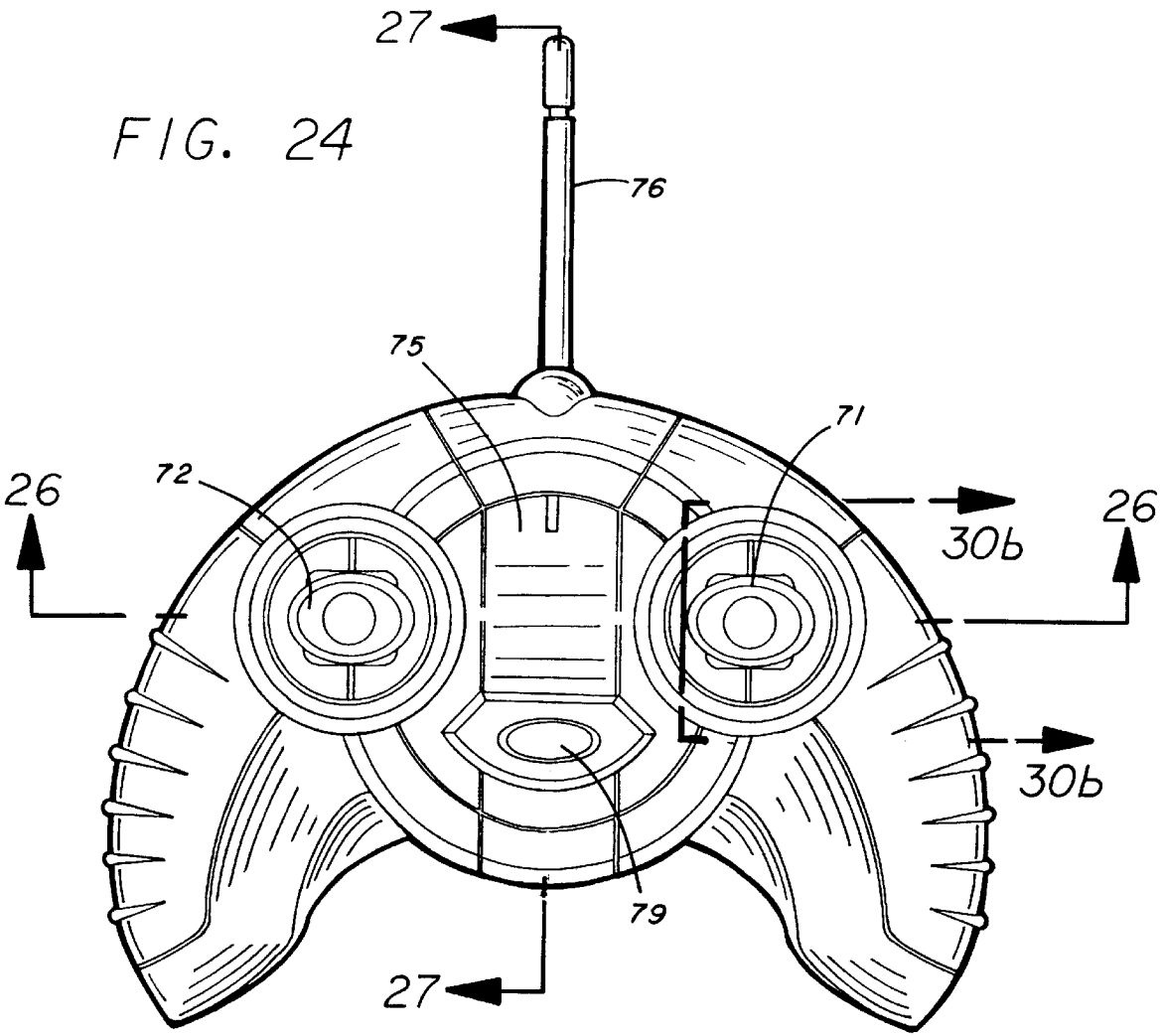
FIG. 24 is a top view of a handheld remote control unit.
Figure 25:
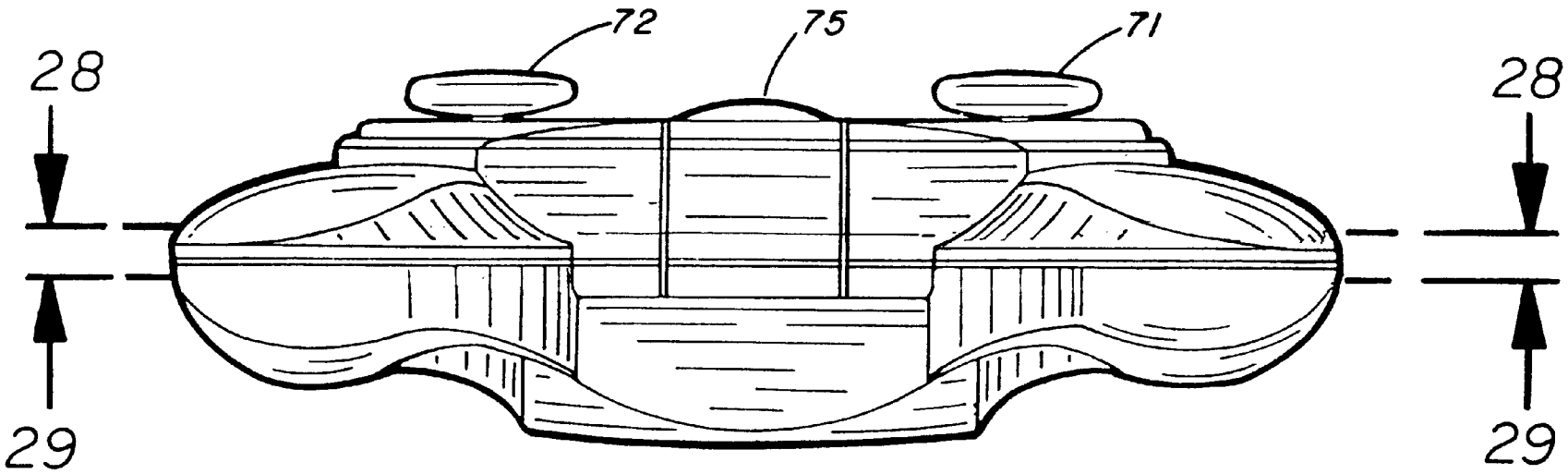
FIG. 25 is a sectional view of a handheld remote control unit.
Figure 26:
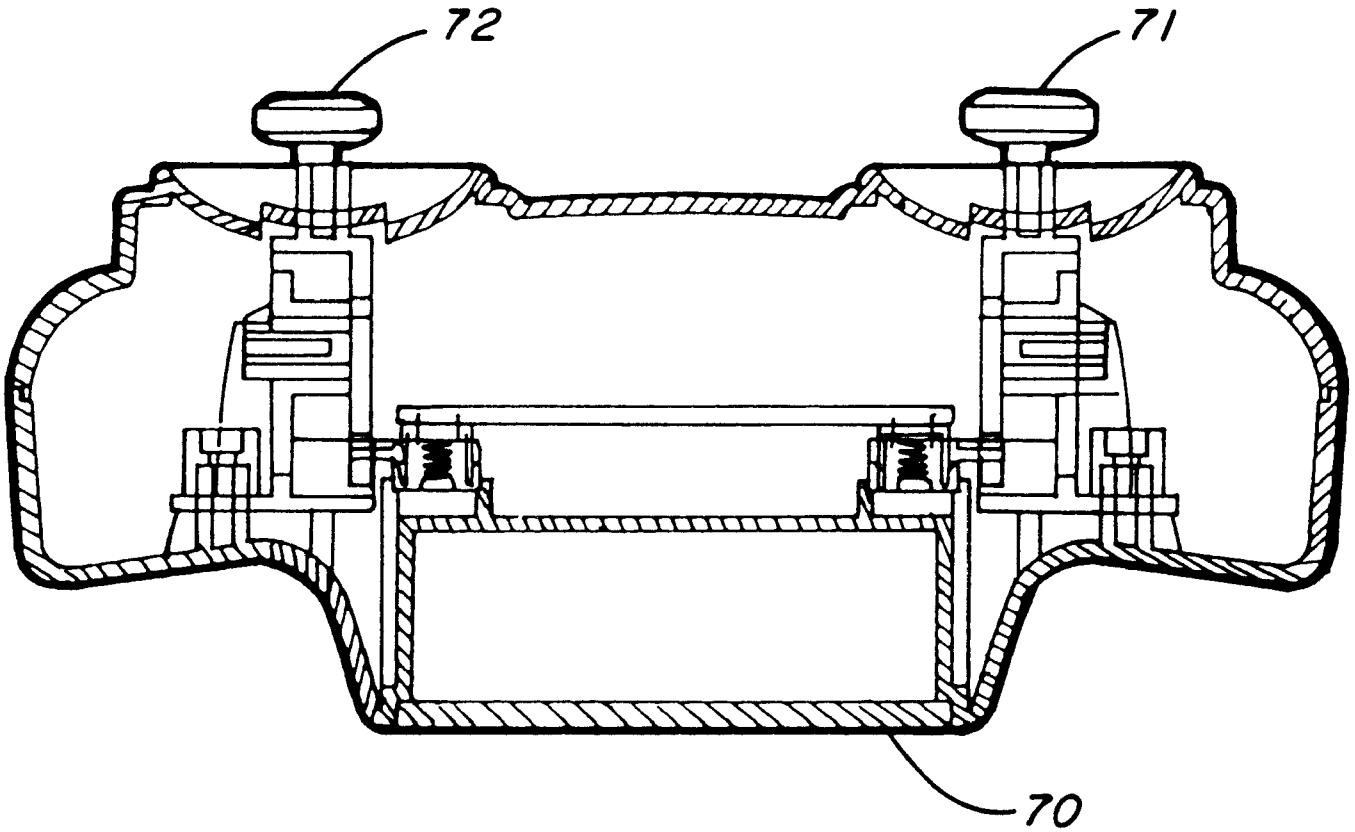
FIG. 26 is another sectional view of a handheld remote control unit.
Figure 27:
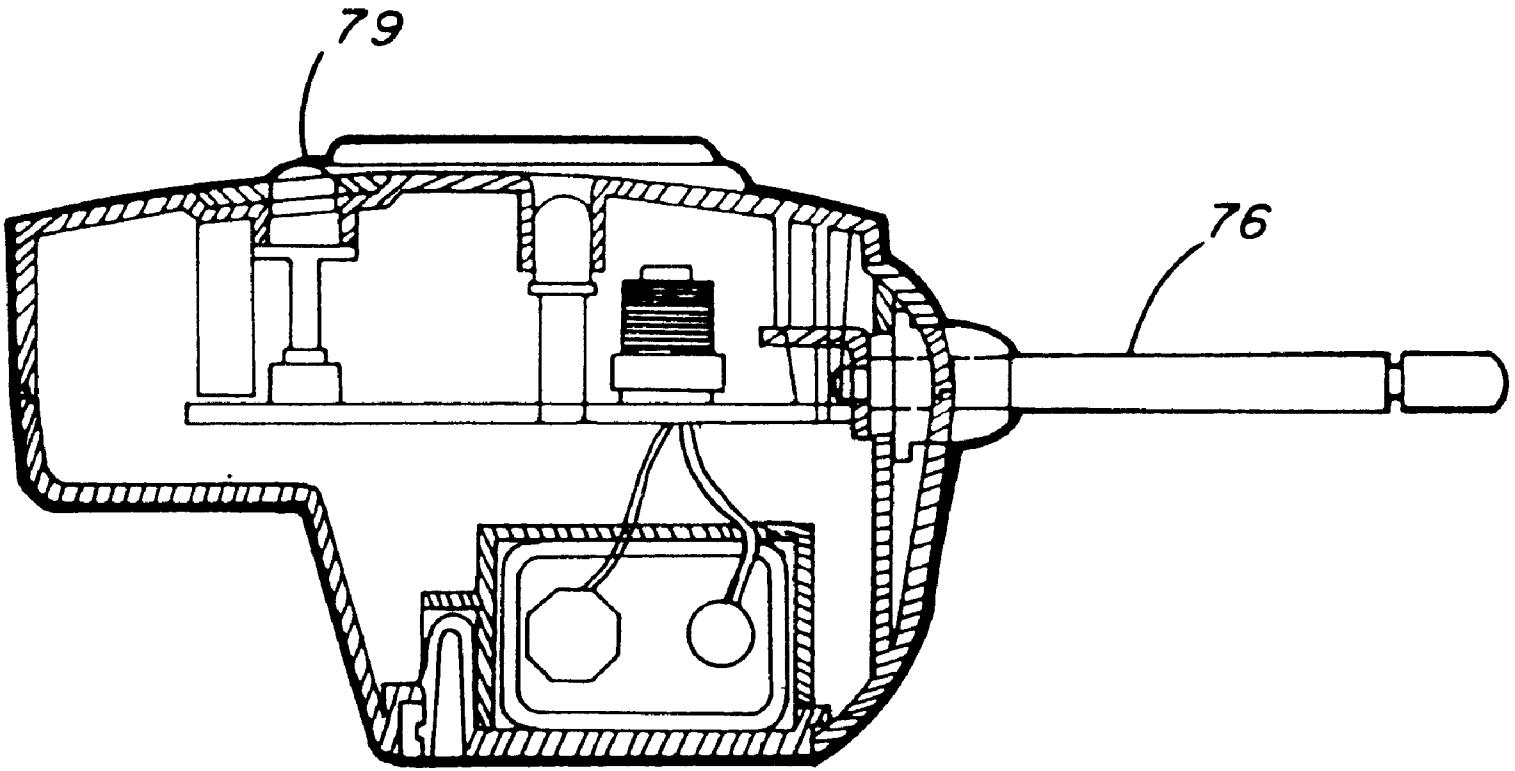
FIG. 27 is a third sectional view of a handheld remote control unit.
Figure 28:
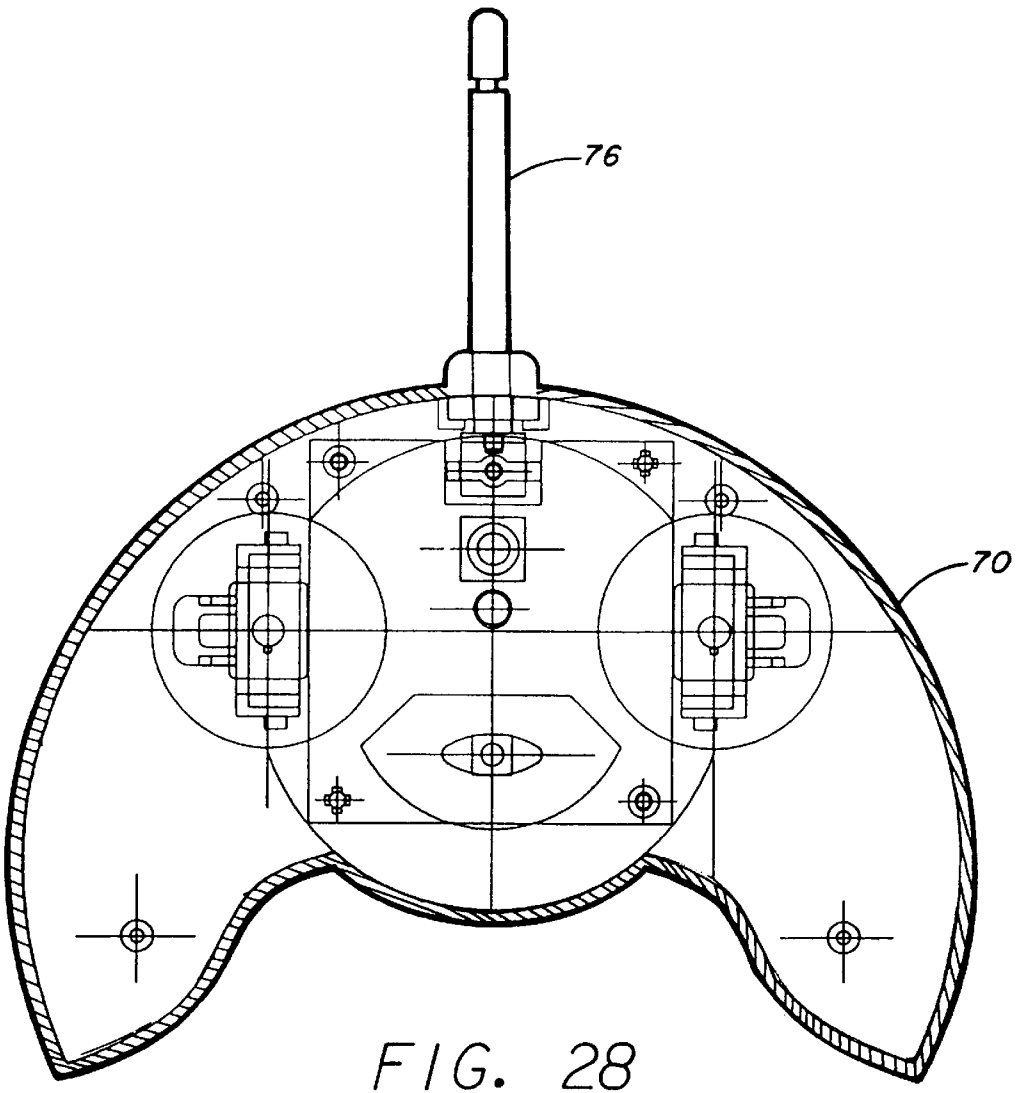
FIG. 28 is a fourth sectional view of a handheld remote control unit.
Figure 29:
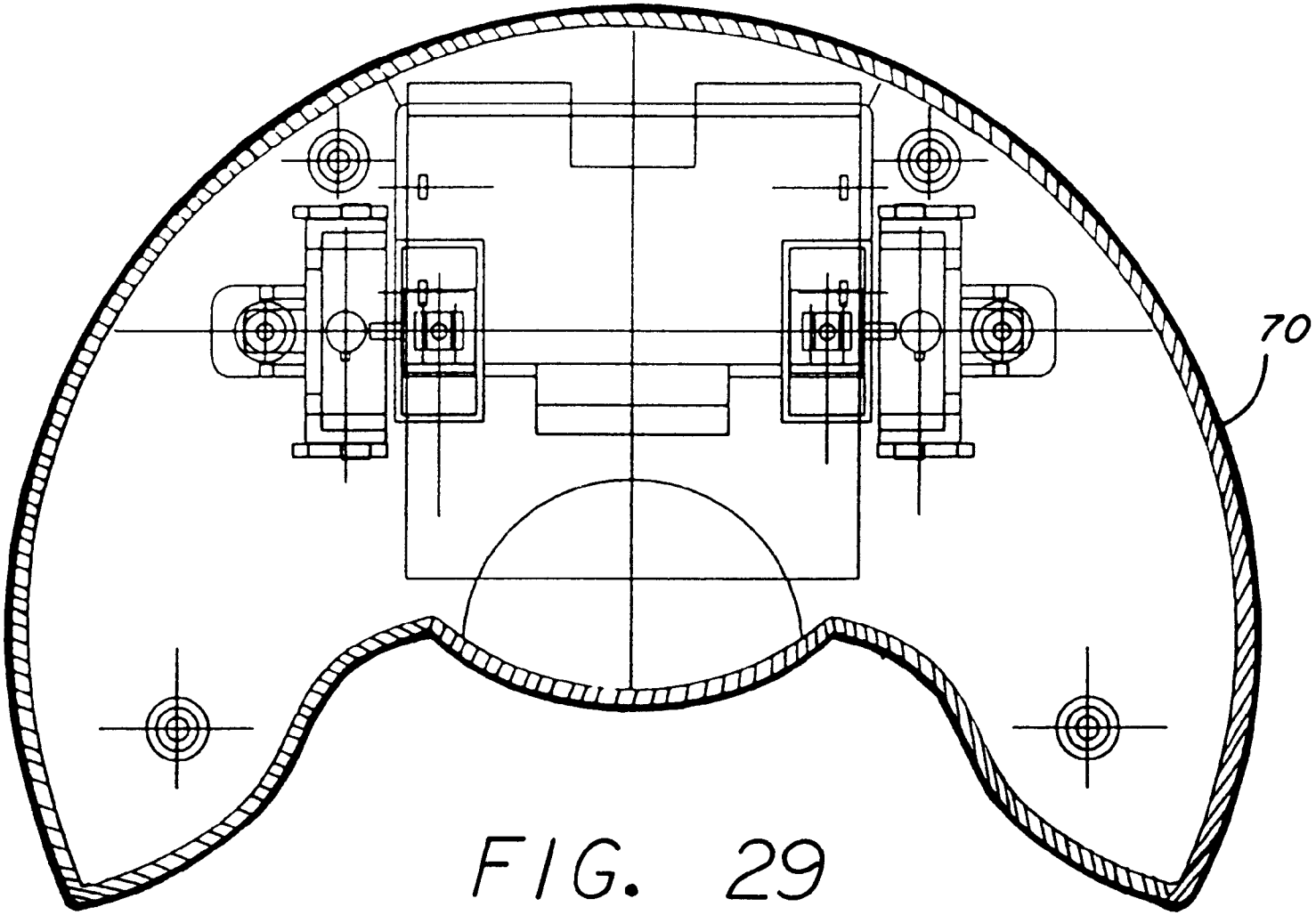
FIG. 29 is a fifth sectional view of a handheld remote control unit.
Figure 30B:
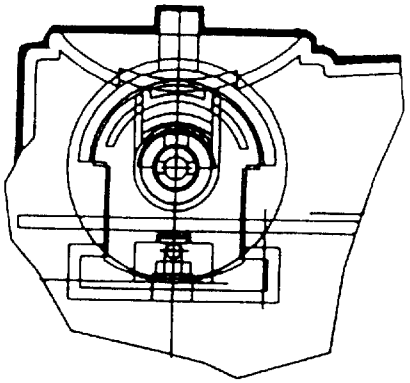
FIGS. 30*a*–30*c* are different sectional views of a portion of a handheld remote control unit.
Figure 30C:
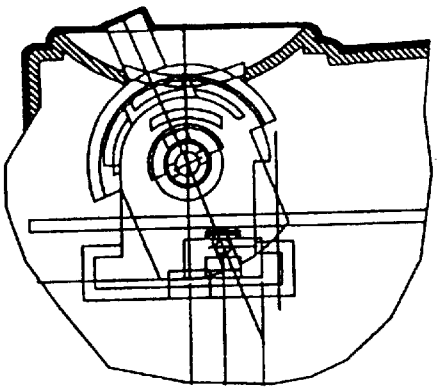
Figure 30A:
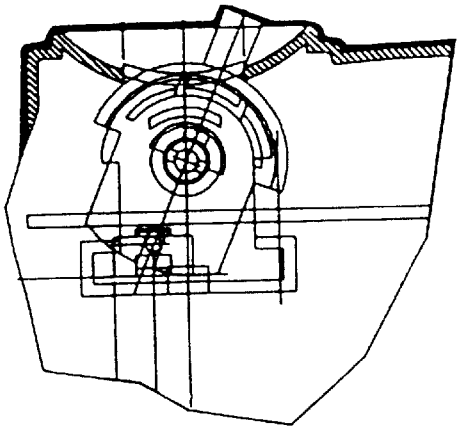
Figure 31:
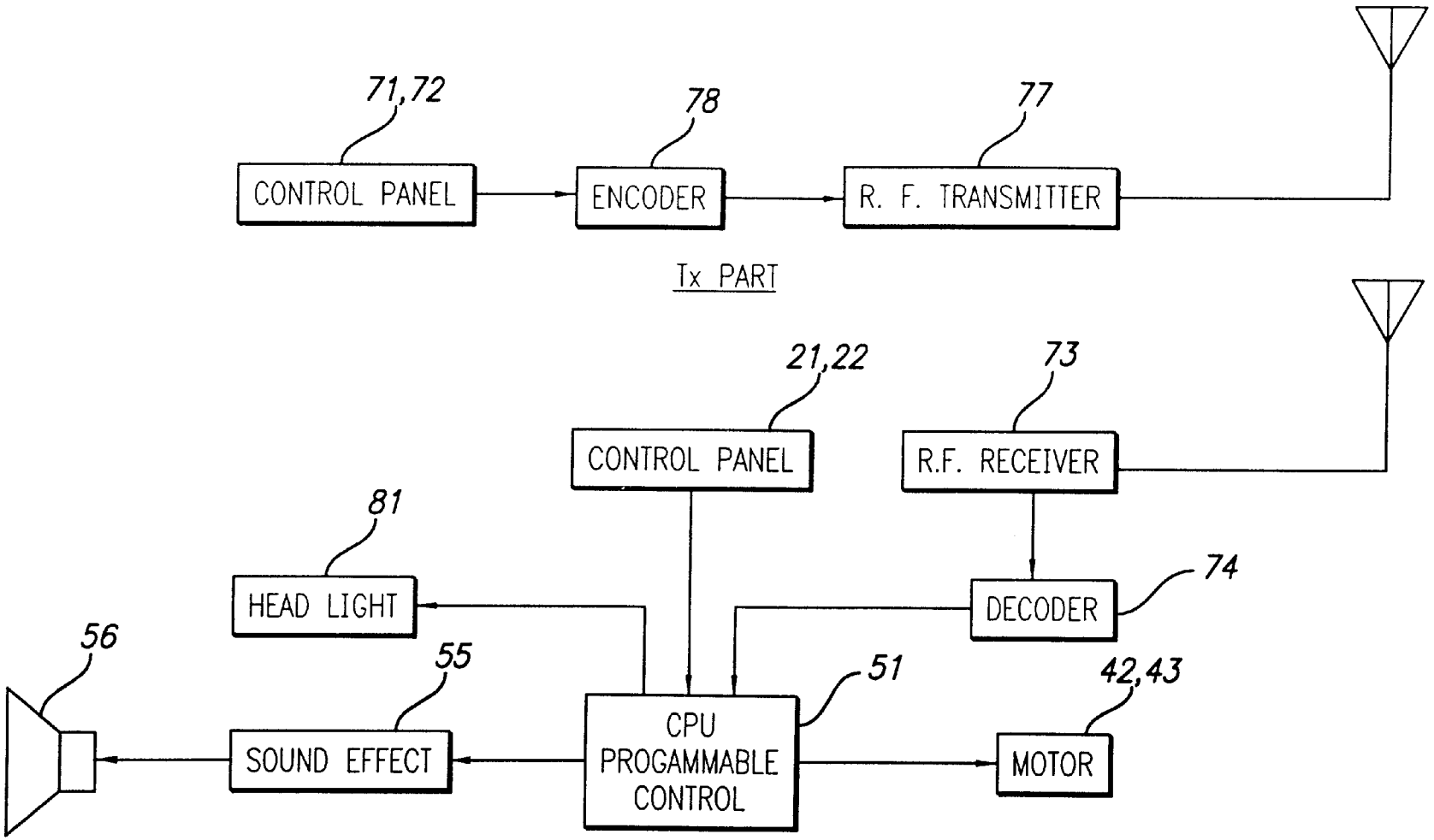
FIG. 31 is a block diagram illustrating the main components of the control units and the microprocessor.

Sensors for determining the environment could be to determine when the body approaches an obstacle and needs to veer in one direction or the other or stop. Changes in temperature or light could also be other things that the sensors could respond to and then cause the programmable microprocessor to vary the action which is preprogrammed into the device. This is illustrated in FIG. 12C.

In some situations, the programming can be effected remotely and be communicated by radio or infrared control.

Further Example

The programmable toy car 20 provides for an interactive programming system for a movable toy. It allows the user to program the object performing a series of preset actions chosen by pressing appropriate keypad buttons 21 and 22 on the car. Those actions are preset in different keys and accompanied by sound effects and light reactions. The programming system is driven by an integrated circuit chip 51, which is responsive to the different keys 21 and 22.

There is a remote control system with the toy. The remote control system 70 is radio controlled. An independent control device 70 is used to instruct the toy to perform individual or separate actions and to activate the preset program. The user can also interrupt or adjust the preset program by pushing forward or pulling backward the appropriate control sticks 71 and/or 72 on the control device 70. A built-in receiver 73 on the toy can translate through decoder 74 the signal transmitted from the control device 70 and to cause the actions, sound and light effects according to the command.

The toy 20 includes both a programming and a remote control system. A programmable and radio frequency controllable toy 20 includes a movable toy with programming keypad buttons, 21 and 22 an integrated circuit chip 51 and receiver 73 built-in. Separately, there is a built-in control unit 70 with control sticks 71 and 72, LED and LCD screen, encoder 78, radio frequency transmitter 77 built-in, and an antenna 76.

The player can drive the movable toy 20 freely in forward, backward, turn left or turn right freely by using the control unit 70. Additionally or alternatively, the player can also run the programmed actions by pressing the "GO" key 79 on the controller 70. If the program is not set, there is an error sound. To interrupt the program, press the "GO" key; press the "GO" key again to restart the entire program. Alternatively, the use of the wheel control buttons causes a pause in the running program. Release causes a continuation of the rest of program automatically.

Control Unit

Radio frequency transmitter 77 to send out the signals.

One Antenna 76 for transmission.

2 control sticks 71 and 72 for direct drive and "Go" key 79 to run the programmed actions.

LED or LCD screen 75 to indicate power "On".

Control Keys

Push Forward Control Stick 72=Turbo Left Wheel Forward

Push Backward Control Stick 72=Turbo Left Wheel Backward

Push Forward Control Stick 71=Turbo Right Wheel Forward

Push Backward Control Stick 71=Turbo Right Wheel Backward

Movable Toy

There are the main keys 21, 22 on the vehicle 20 for programming 14 different stunt actions, 2 demos and "GO" function. Each action is preset with specific distance, speed and timing.

| No. | Stunt Actions |
|---|---|
| 1 | Forward |
| 2 | Backward |
| 3 | Turn left |
| 4 | Turn right |
| 5 | Turbo rotate |
| 6 | Pop Up Wheelie |
| 7 | Vibrate |

-continued

| No. | Stunt Actions |
|---|---|
| 8 | Pause |
| 9 | Sine Curve Forward |
| 10 | Hopping |
| 11 | Sweep |
| 12 | Wavy Rotate |
| 13 | Swing |
| 14 | Quick U-Turn |
| 15 | Demo Action 1 |
| 16 | Demo Action 2 |
| 17 | Go |

The program is input by activating any combination of action keys of 1–14 on the movable toy. Up to a series of 32 actions are storable. Pressing the "GO" key causes the vehicle to run.

The demo is operated by pressing the "Demo" key 22. These demos preferably cannot be programmed. The "Demo" key 22 can activate the car simultaneously, without a need to press the "GO" key.

When the power is on, the movable toy 20 is in a standby mode to receive a signal from the control unit. Should the movable toy be left unattended for 5 minutes, the toy will make a sound for every 5 minutes to remind the player to turn off the power or until the batteries exhausted. The program is stopped by pressing the "GO" key. The entire program is restarted again by pressing the "GO" key once more.

The movable toy includes the following elements.

Radio frequency receiver 73 for translating the received signals from radio frequency transmitter on the control unit.

A one piece antenna 80 for receiving the signals.

An integrated chip 51 for storing the predetermined instructions for action, sound and light effects, and to respond to the different keys 21 and 22 driving the programming system.

Two motors 42 and 43 to react to the signals from the switches connected to the keys 21 and 22 to activate the body to move in different selected direction in the form of wheels 25 and/or 26 or other devices.

Two light bulbs for the headlight 81 associated with the actions. One speaker system 55, 56 for sound effects associated with the actions. An On/Off Switch.

As illustrated in FIGS. 21 to 30*c* the control sticks 71 and 72 can take many positions which can be rotatable, rockable or movable about one or more axes or mounting points as shown. In this manner the remote control of the vehicle can be suitably effected. Suitable batteries can be used in the remote control device. Different shapes and formats can be used for the remote control unit. Likewise different kinds of devices, toys or vehicles can be the subject of the device which is both programmable and separately remotely controllable.

The invention is to be determined solely by the following claims.

I claim:

1. A programmable toy device comprising:

a body;

a motor for activating a motive generator on the body for causing the body to move relative to a surrounding environment;

a key pad mounted on the body including a series of control switches for operation by a user;

the control switches being in the body and being connected with a microprocessor located in the body for translating signals received from the switches into control signals for operating the motor whereby the body is caused to move in different directions according to the action of the motor on the motive generator;

a remote detached controller; and the arrangement being such that the motor, motive generator, key pad, switches and microprocessor are contained with the body, and wherein the switches and key pad are additionally operable or controllable under the action of the remote detached controller, such operation of the detached controller being in addition to a manual activation of the switches by action on the keypad.

2. A device as claimed in claim 1 wherein the motive generator is at least one wheel and the body is representative of a vehicle.

3. A device as claimed in claim 1 wherein the motive generators are a pair of wheels, each wheel being operated by a respective motor.

4. A device as claimed in claim 1 wherein the body is representative of an automobile vehicle and wherein there are four spaced wheels, and wherein two wheels are driven, the two wheels being motive generators.

5. A device as claimed in claim 4 wherein the driven wheels are the rear wheels of the automobile vehicle.

6. A device as claimed in claim 1 wherein the microprocessor is programmable so as to permit for a selection of motions including multiple motions of forward, backward, left turn, right turn or sinusoidal.

7. A device as claimed in claim 6 including the motion of pop-wheeling, and wherein the center of gravity of the vehicle is located strategically relative to the wheels thereby to permit tipping of the vehicle according to the control of the wheel motion and thereby to permit pop-wheeling.

8. A device as claimed in claim 7 including a free roller element located towards the rear of the vehicle, the free roller element being for facilitating motion of the vehicle where the motion is in a tilted pop-wheeled state.

9. A device as claimed in claim 1 including a sound generator and a speaker for transmitting sounds, and means for selectively interacting via activation of the motion generators with sounds from the speaker.

10. A device as claimed in claim 1 including a light generator for creating light, and means for selectively interacting the light generator in relation to the activation of the motive generator.

11. A device as claimed in claim 1 wherein the body is a representation selectively of a boat, train, plane, automobile, or motor bike.

12. A device as claimed in claim 1 wherein the microprocessor is connected to control means for operating the motor, and including control means for operating a light generator and a sound generator.

13. A device as claimed in claim 1 wherein the key pad permits the operation of multiple controls which is thereby to permit the selection of multiple combinations of motion of the body.

14. A device as claimed in claim 1 including sensors for determining the nature of the environment surrounding the device, and means for relating the nature of the environment as sensed selectively to activate a sound, light, or motion according to signals from the sensor.

15. A device as claimed in claim 1 including a radio frequency transmitter and receiver between the toy and the remote detached controller, the transmitter and receiver permitting the device to respond to signals transmitting from the controller to the device.

16. A programmable toy vehicle comprising:

a body;

motor means for activating wheels on the body for causing the body to move on a surface;

a key pad located on the body including a series of multiple control switches for operation by a user;

the control switches being in the body and being connected with a microprocessor located in the body for translating signals received from the switches into control signals for operating the motor whereby the body is caused to move in different directions on the surface according to the action of the motor on the wheels;

the arrangement being such that the motor means, wheels, key pad, switches and microprocessor are contained with the body, and wherein the switches are operable or controllable under the action of the keypad, the body being representative of an automobile vehicle with spaced wheels, and wherein a wheel is driven by the motor means, the microprocessor being programmable so as to permit for a selection of motions;

the microprocessor being connected to control means for operating the motor means, and wherein the key pad permits the operation of the multiple control switches thereby to permit the selection of motion of the body; and a remote detached controller, and the arrangement permitting the switches and microprocessor to be operable additionally under the action of the remote detached controller, such operation of the detached controller being in addition to manual activation of the switches by action on the keypad.

17. A toy as claimed in claim 16 wherein the body is representative of an automobile vehicle and wherein there are four spaced wheels, and wherein two wheels are driven by a respective motor.

18. A toy as claimed in claim 17 wherein the microprocessor is programmable so as to permit for a selection of motions including at least one or multiple motions of forward, backward, left turn, right turn or sinusoidal.

19. A toy as claimed in claim 18 including the motion of pop-wheeling, and wherein the center of gravity of the vehicle is located strategically relative to the wheels thereby to permit tipping of the vehicle according to the control of the wheel motion and thereby to permit pop-wheeling.

20. A toy as claimed in claim 17 including a speaker for creating sounds, and means for selectively interacting via activation of the wheels with sounds from the speaker.

21. A toy as claimed in claims 17 including a light generator for creating light, and means for selectively interacting the light of the light source in relation to the activation of the wheels.

22. A toy as claimed in claim 17 wherein the microprocessor is connected to control means for operating the motor, and control means for operating a light source and a speaker in the body.

23. A toy as claimed in claim 17 wherein the key pad permits the operation of multiple controls which is thereby to permit the selection of multiple combinations of motion of the body.

24. A vehicle as claimed in claim 16 including a radio frequency transmitter and receiver between the toy and the remote detached controller, the transmitter and receiver permitting the vehicle to respond to signals transmitted from the controller to the vehicle.

25. A programmable toy car comprising:

a body and four spaced wheels;

two motor means for activating a respective one of two wheels on the body for causing the body to move on a surface;

a key pad located on the body including a series of multiple control switches for operation by a user;

the control switches being in the body and being connected with a microprocessor located in the body for translating signals received from the switches into control signals for operating the respective motors whereby the body is caused to move in different directions on the surface according to the action of each motor on the respective one of the two wheels;

the microprocessor being connected to control means for operating the two motors and control means for operating a light source and a speaker in the body;

the key pad permitting operation of the multiple controls thereby to permit the selection of multiple combinations of motion of the body;

the arrangement being such that the motors, wheels, key pad, switches and microprocessor are contained in the body, and the microprocessor being programmable so as to permit for a selection of motions including at least one of multiple motions of forward, backward, left turn, right turn or sinusoidal; and a remote detached controller, and the arrangement permitting the switches and microprocessor to be operable additionally under the action of the remote detached controller, such operation of t detached controller being in addition to manual activating of the switches by action on the keypad.

26. A toy as claimed in claim 25 including the motion of pop-wheeling, and wherein the center of gravity of the vehicle is located strategically relative to the wheels thereby to permit tipping of the vehicle according to the control of the wheel motion and thereby to permit pop-wheeling.

27. A toy as claimed in claim 25 including a radio frequency transmitter and receiver between the toy and the remote detached controller, the transmitter and receiver permitting the toy to respond to signals transmitted from the controller to the toy.

28. A programmable toy device comprising:

a body;

a motor for activating a motive generator on the body for causing the body to move relative to a surrounding environment;

a key pad mounted on the body including a series of control switches for operation by a user;

the control switches being in the body and being connected with a microprocessor located in the body for translating signals received from the switches into control signals for programming the microprocessor for operating the motor under multiple different operational programs whereby the body is caused to move in different directions according to the action of the motor on the motive generator;

the arrangement being such that the motor, motive generator, keypad, switches and microprocessor are contained with the body;

the programming permitting for a repetition of a previously programmed movement of the body when a selected control switch is activated by manual action on a keypad with the body;

a remote detached controller;

the switches being additionally operable and controllable under the action of the remote detached controller, such operation of the detached controller being in addition to the manual activation of the switches by action on the keypad;

wherein the microprocessor is programmable so as to permit for a selection of motions including multiple motions of forward, backward, left turn, right turn and sinusoidal;

including the motion of pop-wheeling, and wherein the center of gravity of the vehicle is located strategically relative to the wheels thereby to permit tipping of the vehicle according to the control of the wheel motion and thereby to permit pop-wheeling; and a free roller element located towards the rear of the vehicle, the free roller element being for facilitating motion of the vehicle where the motion is in a tilted pop-wheeled state.

29. A device as claimed in claim 28 including a light generator for creating light, and means for selectively interacting the light generator in relation to the activation of the motive generator.

30. A device as claimed in claim 28 wherein the body is a representation selectively of a boat, train, plane, automobile, or motor bike.

31. A device as claimed in claim 28 wherein the microprocessor is connected to control means for operating the motor, and including control means for operating a light generator and a sound generator.

32. A programmable toy device comprising:

a body;

a motor for activating a motive generator on the body for causing the body to move relative to a surrounding environment;

a key pad mounted on the body including a series of control switches for operation by a user;

the control switches being in the body and being connected with a microprocessor located in the body for translating signals received from the switches into control signals for programming the microprocessor for operating the motor under multiple different operational programs whereby the body is caused to move in different directions according to the action of the motor on the motive generator;

the arrangement being such that the motor, motive generator, keypad, switches and microprocessor are contained with the body;

wherein the microprocessor permits for a repetition of a previously programmed movement of the body when a selected control switch is activated by manual action on a keypad with the body;

a remote detached controller;

the switches being additionally operable and controllable under the action of the remote detached controller, such detached controller operation being in addition to the manual activation of the switches by action on the keypad; and sensors for determining the nature of the environment surrounding the device, and means for relating the nature of the environment as sensed selectively to activate a sound, light, or motion according to signals from the sensor.

33. A toy as claimed in claim 32 wherein the body is representative of an automobile vehicle and wherein there are four spaced wheels, and wherein two wheels are driven by a respective motor.

34. A toy as claimed in claim 33 including a speaker for creating sounds, and means for selectively interacting via activation of the wheels with sounds from the speaker.

35. A toy as claimed in claim 33 including a light generator for creating light, and means for selectively interacting the light of the light source in relation to the activation of the wheels.

36. A toy as claimed in claim 33 wherein the microprocessor is connected to control means for operating the motor, and control means for operating a light source and a speaker in the body.

37. A toy as claimed in claim 33 wherein the key pad permits the operation of multiple controls which is thereby to permit the selection of multiple combinations of motion of the body.

38. A toy as claimed in claim 32 wherein the microprocessor is programmable so as to permit for a selection of motions including multiple motions of forward, backward, left turn, right turn and sinusoidal.

39. A toy as claimed in claim 38 including the motion of pop-wheeling, and wherein the center of gravity of the vehicle is located strategically relative to the wheels thereby to permit tipping of the vehicle according to the control of the wheel motion and thereby to permit pop-wheeling.

40. A programmable toy car comprising:

a body and four spaced wheels;

two motor means for activating a respective one of two wheels on the body for causing the body to move on a surface;

a key pad located on the body including a series of multiple control switches for operation by a user;

the control switches being in the body and being connected with a microprocessor located in the body for translating signal received from the switches into control signals for operating the respective motors whereby the body is caused to move in different directions on the surface according to the action of each motor on the respective one of the two wheels;

the microprocessor being connected to control means for operating the two motors, and control means for operating a light source and a spaeker in the body;

the key pad permitting operation of the multiple controls thereby to permit the selection of multiple combinations of motion of the body;

a remote detached controller;

the switches being additionally operable and controllable under the action of the remote detached controller, such detached controller operation being in addition to the manual activation of the switches by manual action on the keypad; and the arrangement being such that the motors, wheels, key pad, switches and microprocessor arc contained in the body, and the microprocessor being programmable so as to permit for a selection of motions including multiple motions of forward, backward, left turn, right turn and sinusoidal, and the arrangement permits for at least 32 distinct actions.

41. A programmable toy device comprising:

a body;

a motor for activating a motive generator on the body for causing the body to move relative to a surrounding environment;

a key pad mounted on the body including a series of control switches for operation by a user;

the control switches being in the body and being connected with a microprocessor located in the body for translating signals received from the switches into control signals for programming the microprocessor for operating the motor under multiple different operational programs whereby the body is caused to move in different directions according to the action of the motor on the motive generator;

the arrangement being such that the motor, motive generator, keypad, switches and microprocessor are contained with the body;

wherein the microprocessor permits for a repetition of a previously programmed movement of the body when a selected control switch is activated;

wherein there are at least 32 distinct controlling actions of the body; and a remote detached controller; and the switches being additionally operable and controllable under the action of the remote detached controller, such detached controller operation being in addition to the manual activation of the switches by manual action on the keypad.

42. A programmable toy device comprising:

a body;

a motor for activating a motive generator on the body for causing the body to move relative to a surrounding environment;

a key pad mounted on the body including a series of control switches for operation by a user;

the control switches being in the body and being connected with a microprocessor located in the body for translating signals received from the switches into control signals programming the microprocessor for operating the motor under different programs whereby the body is caused to move in different directions according to the action of the motor on the motive generator;

the arrangement being such that the motor, motive generator, keypad, switches and microprocessor are contained with the body;

a sensor for determining the relationship of the body elements to the environment, and thereby permitting the alteration of the action of the body in response to the sensed environment;

a remote detached controller; and the switches being additionally operable and controllable under the action of the remote detached controller, such detached controller operation being in addition to the manual activation of the switches by manual action on the keypad.

43. A device as claimed in claim 42 including operation of a single key on the keypad to permit for the operation of the body in a demonstration mode.

44. A device as claimed in claim 43 including means for repeating a previously programmed movement of the body when a selected control switch is activated.

45. A device as claimed in claim 42 including a battery power source and an automatic shut-off switch for disabling the battery after a preselected time of being in an "on" position without movement of the body.

46. A device as claimed in claim 45 including means for repeating a previously programmed movement of the body when a selected control switch is activated.

47. A programmable toy device comprising:

a body;

a motor for activating a motive generator on the body for causing the body to move relative to a surrounding environment;

a key pad mounted on the body including a series of control switches for operation by a user;

the control switches being in the body and being connected with a microprocessor located in the body for translating signals received from the switches into control signals programming the microprocessor for operating the motor under different programs whereby the body is caused to move in different directions according to the action of the motor on the motive generator;

the arrangement being such that the motor, motive generator, keypad, switches and microprocessor are contained with the body;

means for saving a program procedure for the body and means for adding to the program set of actions by adding additional actions;

a remote detached controller; and the switches being additionally operable and controllable under the action of the remote detached controller, such detached controller operation being in addition to the manual activation of the switches by manual action on the keypad.

48. A programmable toy device comprising:

a body;

a motor for activating a motive generator on the body for causing the body to move relative to a surrounding environment;

a key pad mounted on the body including a series of control switches for operation by a user;

the control switches being in the body and being connected with a microprocessor located in the body for translating signals received from the switches into control signals programming the microprocessor for operating the motor under different programs whereby the body is caused to move in different directions according to the action of the motor on the motive generator;

the arrangement being such that the motor, motive generator, keypad, switches and microprocessor are contained with the body;

a remote detached controller; and the switches are additionally operable and controllable under the action of the remote detached controller, such operation being in addition to the manual activation of the switches by action of the keypad; and means for causing the vehicle to vibrate or shake under the action of the motor on the body.

* * * * *